US010293399B2

(12) United States Patent
Allwood et al.

(10) Patent No.: US 10,293,399 B2
(45) Date of Patent: May 21, 2019

(54) STRIP CASTING

(71) Applicant: Cambridge Enterprise Limited, Cambridge (GB)

(72) Inventors: Julian M. Allwood, Cambridge (GB); Martin McBrien, Cambridge (GB)

(73) Assignee: Cambridge Enterprise Limited, Cambridge (GB)

( * ) Notice: Subject to any disclaimer, the term of this patent is extended or adjusted under 35 U.S.C. 154(b) by 264 days.

(21) Appl. No.: 15/129,680

(22) PCT Filed: Apr. 2, 2015

(86) PCT No.: PCT/GB2015/051046
§ 371 (c)(1),
(2) Date: Sep. 27, 2016

(87) PCT Pub. No.: WO2015/155512
PCT Pub. Date: Oct. 15, 2015

(65) Prior Publication Data

US 2017/0136526 A1 May 18, 2017

(30) Foreign Application Priority Data

Apr. 7, 2014 (GB) ..... 1406204.6

(51) Int. Cl.
*B22D 11/16* (2006.01)
*B22D 11/06* (2006.01)
(Continued)

(52) U.S. Cl.
CPC ..... *B22D 11/168* (2013.01); *B22D 11/009* (2013.01); *B22D 11/064* (2013.01);
(Continued)

(58) Field of Classification Search
CPC ... B22D 11/009; B22D 11/06; B22D 11/0622; B22D 11/064; B22D 11/0651; B22D 11/0662; B22D 11/0682; B22D 11/10; B22D 11/16; B22D 11/168; B22D 11/18; B22D 11/181
(Continued)

(56) References Cited

U.S. PATENT DOCUMENTS 4,936,374 A * 6/1990 Pareg ..... B22D 11/0662 164/428
6,217,803 B1 4/2001 Uozumi
(Continued)

FOREIGN PATENT DOCUMENTS

EP 0572795 A1 12/1993
EP 1083012 A1 3/2001
(Continued)

OTHER PUBLICATIONS

Cullen, J.M. & Allwood, J.M., 2013. Mapping the global flow of aluminum: from liquid aluminum to end-use goods. Environmental science & technology, 47(7), pp. 3057-3064.
(Continued)

*Primary Examiner* — Kevin P Kerns
(74) *Attorney, Agent, or Firm* — Adsero IP

(57) ABSTRACT

Apparatus and methods for casting a metal strip with a cross sectional form which varies along the length of the strip. One embodiment of the apparatus includes opposing cooling systems, a positionable molten metal feed system between the opposing cooling systems, and a form adjustment system. The form adjustment system may include at least one dam to determine, at least in part, the cross sectional form of a molten metal feed to the opposing cooling systems. In this way, it is possible to determine the cross sectional form of the solidified metal strip. The dam is moveable during operation of the apparatus to vary the cross sectional form of the molten metal feed to the opposing cooling systems.

20 Claims, 33 Drawing Sheets

(51) Int. Cl.
*B22D 11/10* (2006.01)
*B22D 11/18* (2006.01)
*B22D 11/00* (2006.01)

(52) U.S. Cl.
CPC ..... *B22D 11/0622* (2013.01); *B22D 11/0651* (2013.01); *B22D 11/0662* (2013.01); *B22D 11/0682* (2013.01); *B22D 11/10* (2013.01); *B22D 11/18* (2013.01); *B22D 11/181* (2013.01)

(58) Field of Classification Search
USPC .... 164/428, 437, 449.1, 453, 467, 480, 488, 164/503
See application file for complete search history.

(56) References Cited

U.S. PATENT DOCUMENTS

| | | | |
|---|---|---|---|
| 6,382,303 | B1 | 5/2002 | Pavlicevic et al. |
| 2003/0205356 | A1 | 11/2003 | Braun et al. |

FOREIGN PATENT DOCUMENTS

| | | | |
|---|---|---|---|
| JP | H05-042345 | A | 2/1993 |
| WO | WO 2001-074517 | A1 | 10/2001 |
| WO | WO 2015-015687 | A1 | 2/2015 |

OTHER PUBLICATIONS

Gerber, H. & Blazek, K., 2000. Twin-roll casting with an electromagnetic edge dam. Conference Record of the 2000 IEEE Industry Applications Conference. Thirty-Fifth IAS Annual Meeting and World Conference on Industrial Applications of Electrical Energy (Cat. No. 00CH37129), pp. 2572-2577.

Li, B., 1998. Solidification processing of materials in magnetic fields. JOM, 50(2), pp. 1-13.

Mao, D., 2003. The principle and technology of electromagnetic roll casting. Journal of Materials Processing Technology, 138(1-3), pp. 605-609.

McBrien, M. & Allwood, J., 2013. Preliminary Design and Assessment of a Novel Electromagnetic Edge Dam for Aluminum Twin Roll Casting. Materials Science Fomm, 765, pp. 87-91.

Milford, R.L., Allwood, J.M. & Cullen, J.M., 2011. Assessing the potential of yield improvements, through process scrap reduction, for energy and CO2 abatement in the steel and aluminum sectors. Resources, Conservation and Recycling, 55(12), pp. 1185-1195.

Monaghan, D. et al., 1993. Microstructural defects in high productivity twin-roll casting of aluminum. Materials Science and Engineering: A, 173(1-2), pp. 251-254.

Smith, D., Keles, O. & Dogan, N., 2004. Fata Hunter Optiflow® variable tip width adjustment system for aluminum sheet casting. In Light Metals-Warrendale-Proceedings-TMS, pp. 719-722.

Vives, C., 1989. Electromagnetic refining of aluminum alloys by the CREM process: Part I. Working principle and metallurgical results. Metallurgical and Materials Transactions B, 2013(Oct. 1989), pp. 623-629.

Whittington, K. et al., 1998. Strip edge containment and position control in twin roll aluminum casting by an electromagnetic method. In TMS Light Metals 1998.

UK IPO search report dated Feb. 6, 2015.

International Search Report dated Nov. 27, 2015.

* cited by examiner

STRIP CASTING

RELATED APPLICATIONS

This application is a 35 U.S.C. § 371 national phase application of PCT/GB2015/051046 (WO 2015/155512), filed on Apr. 2, 2015, entitled "Strip Casting", which application claims the benefit of GB Patent Application No. GB 1406204.6, filed Apr. 7, 2014, which is incorporated herein by reference in its entirety.

BACKGROUND TO THE INVENTION

Field of the Invention

The present invention relates to methods and apparatus for carrying out strip casting of metals. The present invention has particular applicability to twin roll casting, but may also be applied to other continuous or quasi-continuous casting processes, such as belt casting, block casting and DC (direct chill) casting.

Related Art

The present inventors have proposed the use of an electromagnetic edge dam for aluminium twin roll casting. Relevant discussion of this is set out in the reference McBrien and Allwood (2013).

Twin roll casting involves feeding liquid metal between two counter-rotating chilled rolls, where the metal solidifies and forms a sheet of uniform thickness and width. The liquid metal is commonly confined in a fixed ceramic feed system with mechanical 'edge dams' setting sheet width. These must be replaced after each cast, or when sheets of different widths are to be cast.

It is desirable to limit the yield loss of metal between the casting process and the formation of the final product.

McBrien and Allwood (2013) proposed a moveable electromagnetic (EM) edge dam to be used in a twin roll casting process. The non-contact nature of EM containment compared to known mechanical solutions implies a longer casting time may be achieved, while the geometry of the EM edge dam was designed so that the width of the coil may be changed by a simple displacement of the edge dam during casting.

SUMMARY OF THE INVENTION

The present inventors consider that the known methods of strip casting, such as twin roll casting, could be further improved. In particular, in a first development of the invention, they consider that the ability more closely to control the cross sectional form (i.e. the cross sectional shape and/or the cross sectional area) of the solidified metal strip would have significant commercial implications, allowing the casting of strip of a shape which is closer to a desired final shape than the known approaches. This in turn would allow less of the cast strip to be wasted when trimming the cast strip to the desired final shape. The first development of the present invention has been devised in order to address the fact that the known approaches do not provide a satisfactory solution to this problem. Preferably, the present invention reduces, ameliorates, avoids or overcomes this problem.

In a general aspect, the first development of the invention provides control of the molten metal pressure in a molten metal feed during strip casting in coordination with movement of a dam in order to vary the cross sectional form of the molten metal feed to the rollers and thus the cross sectional form of the solidified metal strip.

Accordingly, in a first preferred aspect, the first development of the present invention provides a continuous casting apparatus for casting a metal strip with a cross sectional form which varies along the length of the strip, the continuous casting apparatus comprising:

opposing cooling means;

a molten metal feed system positionable to provide a molten metal feed for solidification between the opposing cooling means to form a solidified metal strip along a length direction;

a form adjustment system comprising at least one dam to determine, at least in part, the cross sectional form of the molten metal feed to the opposing cooling means, and thereby to determine the cross sectional form of the solidified metal strip, wherein the dam is moveable during operation of the apparatus to vary the cross sectional form of the molten metal feed to the opposing cooling means, the continuous casting apparatus further comprising:

a molten metal pressure control system, operable to control the pressure of the molten metal in the molten metal feed during operation of the apparatus in coordination with movement of the dam.

In a second preferred aspect, the first development of the present invention provides a continuous casting method for casting a metal strip with a cross sectional form which varies along the length of the strip, the method comprising:

providing a molten metal feed for solidification between two opposing cooling means to form a solidified metal strip along a length direction;

operating a form adjustment system comprising at least one dam to determine, at least in part, the cross sectional form of the molten metal feed to the opposing cooling means, and thereby to affect the cross sectional form of the solidified metal strip, wherein the dam is moved during operation of the device to vary the cross sectional form of the molten metal feed to the opposing cooling means, operating a molten metal pressure control system to control the pressure of the molten metal in the molten metal feed during casting in coordination with movement of the dam.

The first and/or second aspect of the first development of the invention may have any one or, to the extent that they are compatible, any combination of the following optional features.

Preferably, the present invention is used in twin roll casting. In this case, the opposed cooling means are rolls. Twin roll casting is particularly well suited, because the downstream deformation (i.e. the deformation applied to the strip, subsequent to twin roll casting, in order to manufacture a final product) is typically relatively small. Therefore subsequent rolling of the strip is not usually carried out, or only carried out to a minor extent. This means that the irregular cross sectional form of the strip is not significantly elongated.

Alternatively, the present invention may be applied to other continuous or quasi-continuous casting processes, such as belt casting, block casting and DC (direct chill) casting.

The cross sectional form of the cast strip includes the cross sectional shape and/or the cross sectional area of the cast strip. In this art, the term "cross sectional profile" is typically reserved to describe variations in the thickness of the strip across its width. This terms is therefore included within the scope of the term "cross sectional shape". Preferred embodiments of the invention can therefore be used to change, during casting of a continuous strip, the cross sectional form of the strip, for example by increasing the width of the strip and/or decreasing the width of the strip and/or including holes in the strip. It is intended that the variation in the cross sectional form of the strip does not consist only of uniform variations (across the width of the strip) of the thickness of the strip. Such variations in thickness may be achieved, for example, by changing the spacing and velocity of the rolls and/or solidification length along the rolls during a casting run.

It is preferred that the width of the strip is at least 500 mm, more preferably at least 1000 mm. The width of the strip is typically not greater than 2000 mm. The thickness of the strip is preferably at least 1 mm, more preferably at least 2 mm. The thickness of the strip may be up to 10 mm. There is no particular restriction on the length of the strip. In practice, the maximum length of the strip is dictated by the available metal to be cast and the ability of the manufacturer to handle the cast strip, e.g. by taking the cast strip onto a coiler.

Preferably, the dam is an AC electromagnetic field dam provided by at least one electromagnet. Preferably the electromagnetic field dam is operated at a frequency of at least 0.5 kHz. More preferably, the electromagnetic field dam is operated at a frequency of at least 1 kHz. The electromagnetic field dam may be operated at a frequency of up to 100 kHz. More preferably, the electromagnetic field dam is operated at a frequency of up to 50 kHz, or up to 30 kHz.

Preferably, the electromagnetic field dam is operable to provide a magnetic field strength (magnetic flux density) of at least 25 mT within the molten metal feed.

Preferably, the electromagnet which provides the electromagnetic field dam is operable to provide at least 1000 At (ampere-turns) of magnetomotive force.

The electromagnet preferably has a flux concentrator and current-carrying windings, in a known manner. The flux concentrator preferably has a horseshoe-shape, or C-shape, with a gap provided in order to fit the flux concentrator around the feed tip. The shape of the flux concentrator is adapted to conform with the shape of the rolls near the feed tip, which is discussed below. The electromagnet is preferably oriented so that the arms of the horseshoe-shape, or C-shape, meet behind the feed tip, along the longitudinal direction of the cast strip. This allows the dam to be moved within a wide range along the feed tip, transversely to the direction of casting.

The molten metal feed system typically includes a feed tip. This typically conveys the molten metal to the opposed cooling means. There may be provided a reservoir of molten metal. This may be in fluid communication with the feed tip via a conduit. The reservoir, conduit and/or feed tip may be provided with suitable heating and/or insulation in order to maintain the molten metal at a desired temperature before solidification. Ignoring losses in the conduit and feed tip (which is appropriate particularly in the case of the relatively small flow rate in twin roll casting for example), the static pressure of molten metal in the feed tip is substantially the same as the static pressure of molten metal in the reservoir at the same height as the feed tip. The pressure of molten metal at the feed tip can therefore be controlled by controlling the pressure of molten metal in the reservoir. Conveniently, this can be done by controlling the level of molten metal in the reservoir. One way to do this would be to raise or lower the reservoir with respect to the feed tip. However, this would require a flexible conduit, and so this is not particularly preferred. A more preferred option is to displace the molten metal in the reservoir, in order to control the position of the level of the molten metal in the reservoir compared with the feed tip.

A particularly preferred arrangement has a displacement body arranged to be pushed into the reservoir. A suitable displacement body is sized and shaped to as to fit into the reservoir to leave a suitable space for the molten metal in the reservoir. A suitable displacement body is insulated and/or actively heated in order to limit its effect on cooling the molten metal. Pushing the displacement body into the reservoir displaces the molten metal, thereby changing the level of the molten metal in the reservoir. In turn, this adjusts the static pressure of the molten metal in the reservoir and in the feed tip.

An advantage of using a displacement body to control the pressure compared with, for example, restricting the flow of molten metal along the conduit, is that it is possible to achieve fast and precise adjustments of the molten metal pressure.

Preferably, when the dam is moved so as to increase the width of the strip, the molten metal pressure is increased. It is considered that this provides an advantage by more quickly filling the space in the feed tip which previously was occluded by the dam. This allows a faster and more certain increase in width of the strip.

Preferably, once the dam has been moved to increase the width of the strip and the width has increased to the desired amount, the molten metal pressure is reduced. For example, the molten metal pressure may be reduced to a level corresponding to the level used before the width of the strip was increased.

Preferably, when the dam is moved so as to decrease the width of the strip, the molten metal pressure is decreased. It is considered that this provides an advantage by reducing the force acting against reduction of the strip width. This allows a faster and more certain decrease in width of the strip.

Preferably, once the dam has been moved to decrease the width of the strip and the width has decreased to the desired amount, the molten metal pressure is increased. For example, the molten metal pressure may be increased to a level corresponding to the level used before the width of the strip was decreased.

In this way, it is preferred that the molten metal pressure control system is used to adjust the molten metal pressure during movement of the dam, so as to increase the speed of reliable change of the cross sectional form of the strip.

Furthermore, the molten metal pressure control system can be used to maintain substantially constant molten metal pressure where it is required to maintain a substantially constant cross sectional form of the strip, e.g. constant width.

Preferably, the method allows substantially a step change in the cross sectional form of the strip. For example, the method may allow the width of the strip to be changed by at least 10% over a distance of 30 cm along the longitudinal (casting) direction of the strip. In some embodiments, the method allows steeper width changes to be achieved. For example, it is possible to achieve a change of width of the strip of at least 10% over a distance of 10 mm or less along the longitudinal (casting) direction of the strip. Even greater changes of width can be achieved. For example, it is possible to achieve a change of width of the strip of up to 50% over a distance of 10 mm or less along the longitudinal (casting) direction of the strip. In this case, the absolute change in width is from 130 mm to 65 mm. Here, the edge dam moves at a speed of about 100 mm/s, which is much greater than demonstrated by Smith et al. (2004) with a mechanical dam (1.5 mm/s).

The dam may be moveable in the sense, for example, of an electromagnet being moveable transversely along the feed tip. However, it is possible to provide an array of at least two dams at different positions which are capable of being selectively switched into operation. The effect of switching from one dam to the other has the effect of moving the damming position. Thus, this is equivalent to moving the dam. There may be provided an array of more than two dams, for example, three, four, five, six or more. The actual positions of the dams may be fixed with respect to the feed tip, but selectively switching the dams on and off provides an effectively moveable dam. Preferably, these dams are EM dams.

The dam may be an edge dam, in the sense that control of the edge dam controls the position of the edge of the cast strip. There may be provided edge dams at opposing sides of the cast strip.

However, it is not necessarily essential for the dam to be an edge dam. This is because the inventors have realised that the operation of a dam with flow of molten metal on each side of the dam makes the dam act as a diverter, diverting the flow of motel metal out of a particular region in which the diverter acts. Where the diverter is not at the external edge of the molten metal flow, operation of the diverter can cause the formation of an opening in the cast strip. Movement of the diverter can cause a corresponding change in the shape of the opening as casting continues. Further movement of the diverter, and/or deactivation of the diverter can close up the opening.

The diverter can be an EM diverter, having a structure and operational capabilities as describe above in relation to the EM dam. There may be provided one or more moveable diverters. Alternatively there may be provided an array of two or more static diverters which can be switched into and out of operation as for the array of static dams described above.

The inventors have realised that pressure control may, however, not be necessary when using a diverter (although it may be preferred). Accordingly, in a second development of the invention, the inventors have considered further possible improvements that could be made to strip casting. They have realised that it is possible to affect the cross sectional form of the strip not only in terms of the positions of the edges of the strip, but also in terms of locating holes in the strip. "Holes" here can be voids through the thickness of the strip that are enclosed or partially open. In preferred embodiments, they are enclosed.

Controlling the cross sectional form of the strip in this way has advantages in the sense of reducing wastage when the desired product includes a hole in the strip. Therefore, again, control of the cross sectional form (i.e. the cross sectional shape and/or the cross sectional area) of the solidified metal strip has significant commercial implications, allowing the casting of strip of a shape which is closer to a desired final shape than the known approaches. This in turn allows less of the cast strip to be wasted when trimming the cast strip to the desired final shape. The second development of the present invention has been devised in order to address this problem. Preferably, the present invention reduces, ameliorates, avoids or overcomes this problem.

In a general aspect, the second development of the invention provides operation of a diverter to part the molten metal feed laterally in order to vary the cross sectional form of the molten metal feed to the rollers and thus the cross sectional form of the solidified metal strip, thereby providing at least one hole in the solidified metal strip.

Accordingly, in a first preferred aspect, the second development of the present invention provides a continuous casting apparatus for casting a metal strip with a cross sectional form which varies along the length of the strip, the continuous casting apparatus comprising:

opposing cooling means;

a molten metal feed system positionable to provide a molten metal feed for solidification between the opposing cooling means to form a solidified metal strip along a length direction;

a form adjustment system comprising at least one diverter, wherein the diverter is operational to part the molten metal feed laterally in order to vary the cross sectional form of the molten metal feed to the rollers and thus the cross sectional form of the solidified metal strip, thereby providing at least one hole in the solidified metal strip.

In a second preferred aspect, the second development of the present invention provides a continuous casting method for casting a metal strip with a cross sectional form which varies along the length of the strip, the method comprising:

providing a molten metal feed for solidification between two opposing cooling means to form a solidified metal strip along a length direction;

providing a form adjustment system comprising at least one diverter, and operating the diverter to part the molten metal feed laterally in order to vary the cross sectional form of the molten metal feed to the rollers and thus the cross sectional form of the solidified metal strip, thereby providing at least one hole in the solidified metal strip.

The first and/or second aspect of the second development of the invention may have any one or, to the extent that they are compatible, any combination of the following optional features, and/or any one or, to the extent that they are compatible, any combination of the optional features set out with respect to the first development.

In particular, preferred features of the dam set out with respect to the first development may be applied to the diverter of the second development. For example, the diverter is preferably an electromagnetic diverter. It may be moveable. More than one may be provided, in order to generate the required variation in cross sectional form for the cast strip. An array of two or more diverters may be provided. These may be static, the required variation in cross sectional form for the cast strip being provided by suitable control of diverters in the array.

Optionally, there is provided a molten metal pressure control system, operable to control the pressure of the molten metal in the molten metal feed during operation of the apparatus in coordination with operation of the diverter. Where the diverter is operated to divert molten metal away from a particular region, the diversion may be assisted by a corresponding reduction in static pressure of the molten metal in the feed system. This is advantageous when the overall cross sectional area of the strip is reduced by the operation of the diverter. Similarly, when the diverter is switched off or otherwise operated to increase the overall cross sectional area of the strip, increasing the static pressure of the molten metal in the feed system can assist in filling the required area. These changes in molten metal pressure can be achieved as set out above in relation to the first development.

Unlike an edge dam, it is intended that the diverter operates to allow a flow of molten metal on each transverse side. It is therefore necessary to consider how the molten metal should reach each side. It is possible to provide more than one feed conduit from the molten metal reservoir. A first feed conduit may supply molten metal to one transverse side of the diverter and a second feed conduit may supply molten metal to the other transverse side of the diverter. Where more than one diverter is provided, there may be provided corresponding feed conduits for each transverse side of each diverter.

Where the diverter is moveable, providing an array of feed conduits corresponding to each possible position of the diverter may be impractical. In this case, at least one bypass conduit may be provided. The bypass conduit may be operational to allow molten metal to reach a transverse side of the diverter distal from a main feed conduit to the feed tip.

In the case of an EM diverter, the bypass conduit may be a conduit which substantially shields molten metal within the bypass conduit from the EM field. For example, the bypass conduit may be a conduit formed within the feed tip. The bypass conduit may be formed of an electrically conductive material, e.g. a metal such as a refractory metal.

The present inventors have recognised that the operation of a diverter to divert molten metal flow may present a more significant challenge compared with the operation of an edge dam. This is due to the diverter having to push molten metal out of the required location within the body of the molten metal flow, rather than at an edge position. There may therefore be provided one or more diverter assistance features. These may be provided, for example, within the feed tip. They may have a fixed position. In the case of an EM diverter, a suitable diverter assistance feature is a structural feature which allows the EM field generated by the EM diverter to be concentrated in the feed tip. Typically, the concentration of the EM field is coincident with the position of the diverter assistance feature. The effect of this is that as the EM field generated by the EM diverter grows, the EM field is concentrated at the diverter assistance feature and a void is nucleated in the molten metal. This void grows due to the concentration of the EM field in the void, diverting the molten metal and forming an opening.

A suitable diverter assistance feature is a structural feature which reduces or blocks the flow of molten metal at that feature, but allows the EM field to penetrate more easily than the EM field can penetrate the molten metal. For example, a diverter assistance feature can be provided by a projection of a non-ferromagnetic material (e.g. a non-electrically conductive material such as a ceramic) within the feed tip. A suitable projection can project forwardly from a rear internal face of the feed tip. Additionally or alternatively, a suitable projection can project upwardly or downwardly from an internal face of the feed tip corresponding to a major surface of the cast strip.

Once a suitable opening is formed in the molten metal, the diverter can be controlled (e.g. moved) to control the shape of the hole.

Further optional features of the invention are set out below.

BRIEF DESCRIPTION OF THE DRAWINGS

Embodiments of the invention will now be described by way of example with reference to the accompanying drawings in which:

FIG. 9 shows a view of a cast strip and the effect on the width when the EM dam is switched on.

DETAILED DESCRIPTION OF THE PREFERRED EMBODIMENTS, AND FURTHER OPTIONAL FEATURES OF THE INVENTION

Significant amounts of aluminium are cast and then cut away in the process of making irregularly-shaped products because the supply chain is configured to make stock products which are all regular shapes. Better integration of the supply chain for sheet metal products is possible where an electromagnet is used to manipulate the profile of sheet metal in twin roll casting. Below, the first experimental trials are presented, during which one edge of the sheet was controlled and moved by the electromagnet.

The aluminium supply chain is split into two distinct parts: the metals industry, which produces aluminium from ore and then casts and rolls the metal to make stock products such as coils of sheet, and the manufacturing industries which take these stock products and reshape them to make consumer products, for example car doors. This makes the supply chain subtractive; a large fraction of the metal cast is removed and does not reach the final consumer product. This loss may be quantified by the yield which is the ratio of metal in the final product to the original mass of metal cast. Cullen and Allwood (2013) calculate the average yield across all aluminium products as 60%, and in a case study of an aluminium car door Milford et al. (2011) found a yield of 40%, with half of the metal subtraction attributable to the rectangular sheet being cut to create a door and window outline in the blanking and stamping processes. Therefore, the ability to cast the outline of irregular sheet products directly would create an opportunity for a significant improvement in yield.

Figure 1:
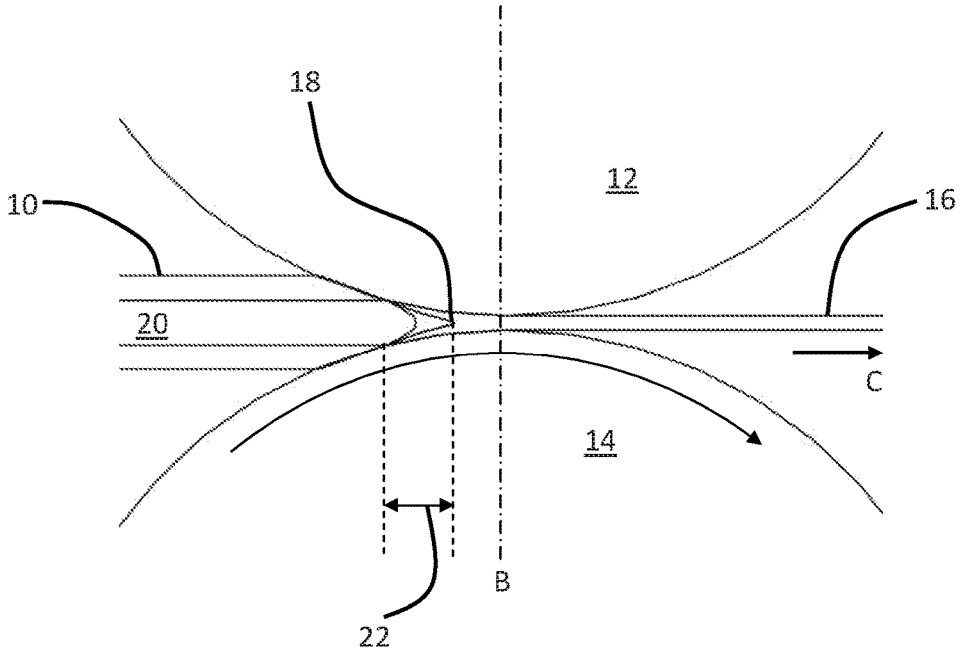
Fig. 1 PRIOR ART
FIG. 1 shows a schematic cross sectional view of a twin roll caster showing the area of solidification.

The preferred embodiments of the invention build on existing efforts to cast nearer to net thickness by adding extra controls to allow the profile of irregular sheet products to be cast directly. The most established direct sheet casting process, twin roll casting, is taken as the starting point. As illustrated in FIG. 1, in twin roll casting (TRC), sheets are cast directly by feeding liquid metal 20 through a refractory (e.g. ceramic) feed tip 10 between two counter-rotating cooled rolls 12, 14 (the opposed cooling means). As soon as the liquid metal touches the rolls it starts to form a solid shell which grows as it moves towards the roll bite, marked as line B. The shells on the top and bottom roll meet at a solidification point 18 just before the roll bite and from there the sheet 16 is deformed as it is in the hot rolling process. A cross section of the solidification region is shown in FIG. 1. The casting direction is direction C. The sump depth is marked as 22.

An electromagnetic (EM) edge dam can be used to manipulate the metal by applying a pressure along the sump during casting, allowing for control of the edge of the metal so varying the width of the cast sheet. As discussed in more detail below, an EM edge dam can be used on each edge of the strip and/or EM actuators can be added to cast strip with holes (requiring additional modifications to the metal feed). As a first step, in this disclosure the process is demonstrated by controlling one edge of a cast strip on a laboratory scale twin roll caster.

The methods of setting and changing width in conventional twin roll casting processes and the principles of electromagnetic containment are described below, and the opportunity of using an EM edge dam for width control identified.

The twin roll casting process is described in detail in the text by Ferry (2006). Liquid aluminium is fed into the back of a TRC via a refractory feed tip, which fully contains the metal until it is solidified. The top and bottom pieces end at a fixed setback from the roll bite determined by the desired solidification length. Two edge pieces protrude further towards the roll bite to provide a physical barrier to the liquid metal, thereby acting as static mechanical edge dams. In order to vary the width of the strip, the casting process must be halted, and either a new feed tip with a different width inserted or refractory plugs used to reduce the width of the aperture in the existing feed tip.

Smith et al. (2004) propose and demonstrate on a pilot caster the Fata Hunter Optiflow system, which separates the edge dam from the feed tip so it may slide inside the tip, transversely along the width. A graphite seal prevents liquid aluminium from leaking through the gap and the edge dam is actuated to give a controlled width. Without stopping casting, they demonstrated a width increase of 200 mm incrementally over two hours of casting, at a maximum rate of 1.5 mm/s. The Optiflow system is designed to cast sequential coils of sheet at different widths without interrupting casting, but problems could be encountered when trying to move the edge dam at much faster rates: can the graphite maintain a good seal in the feed tip, will its lifetime be compromised by rapid motions, and how does the moving edge dam interact with the partially solidified shell when decreasing the width? No follow up report has been made in the literature.

With all mechanical edge dams, there is a sliding contact between the solid shell which is moving forward and the static metal-facing surface of the edge dam. Friction and unwanted heat transfer out of the strip leads to defects at its edges. In particular edge cracks form via the mechanism described by Monaghan et al. (1993). The extra heat transfer through the edge dam causes solidification to occur earlier at the edges of the strip than at the centre, and therefore when the strip is rolled the edges are deformed more leading to cracking, particularly with hard alloys. This is a common problem in aluminium twin roll casting and as a result all industrial casters have edge trimming downstream to remove the cracked area, normally 20-30 mm from the total width of 2000 mm (Romano and Romanowski, 2009).

Given these defects, electromagnetic (EM) containment has already been proposed and demonstrated for use in aluminium twin roll casting. The principle, derived in more detail by Davidson (2001), involves applying an AC magnetic field tangentially to the surface being contained. At a suitably high frequency (on the order of kHz), the alternating field may only diffuse a small distance into the metal (the 'skin depth'). An electrical current is induced in the surface of the metal, and the interaction of the applied magnetic field with this current produces a magnetic pressure that acts to repel the metal from the field. The average magnetic pressure, $P_m$, is given in Equation (1). $\mu_0$ is the permeability of free space and $B_0$ is the magnitude of the magnetic field.

$$P_m = \frac{B_0^2}{4\mu_0} \quad \text{Equation (1)}$$

Figure 2:
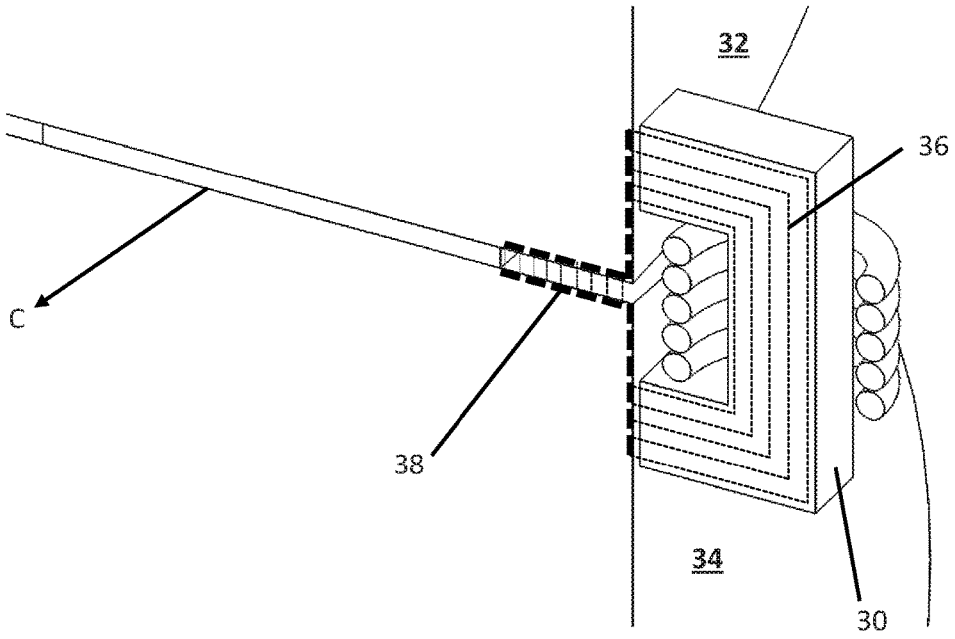
Fig. 2 PRIOR ART
FIG. 2 shows a schematic partial cross sectional view of the EM edge dam arrangement of Whittington et al (1998).

The use of EM edge dams in twin roll casting has been demonstrated on a laboratory scale by Whittington et al. (1998) for horizontal aluminium TRCs, and in a theoretical design proposed by Gerber (2000) for vertical steel casters. The geometry of the Whittington EM edge dam and its magnetic field are shown in FIG. 2. The Whittington design is a horseshoe-shape core 30 bolted to the side of the caster, which uses the fact that the steel rolls 32, 34 are magnetic to direct flux 36, 38 into the roll bite. The distribution of the magnetic field is such that an increase in pressure in the aluminium would cause the field to bunch up and increase in strength, so that the arrangement is inherently stiff and stable.

The Whittington EM edge dam was operated at 16-30 kHz with up to 4000 At applied, and successfully contained one edge of a cast strip. A small width variation of 3 mm was noted when changing the current applied to the EM edge dam during start-up, but because the field attenuates quickly away from the magnet large changes in width would be impossible by varying current alone. The operating frequency was chosen based on an optimisation for stiffness; at this frequency the change in width with pressure in the aluminium is minimised. The skin depth in the aluminium is 0.6 mm. With 4000 At applied, the EM edge dam requires water cooling to extract heat generated by eddy currents and hysteresis in the core.

The Gerber design uses a wedge shaped conductor with no flux concentrator, with a magnetic field generated in concentric circles around it. The geometry of the conductor is designed so that the field becomes strongest at the roll bite, where the static pressure is greatest, so that the free liquid metal surface is approximately vertical.

Figure 3:
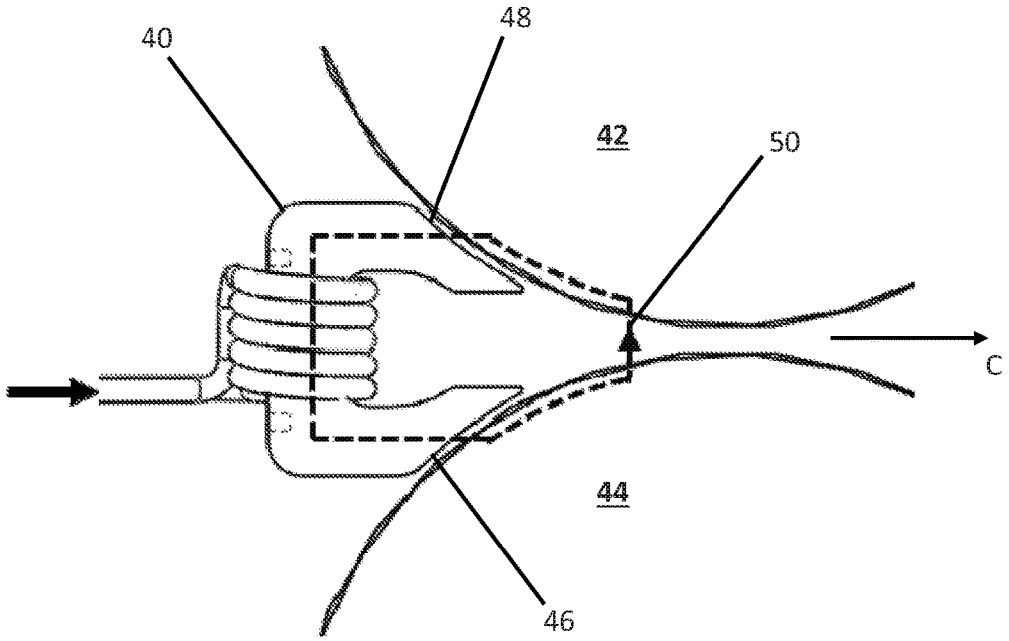
Fig. 3 PRIOR ART
FIG. 3 shows a schematic side view of the EM edge dam arrangement of McBrien and Allwood (2013).
Figure 4:
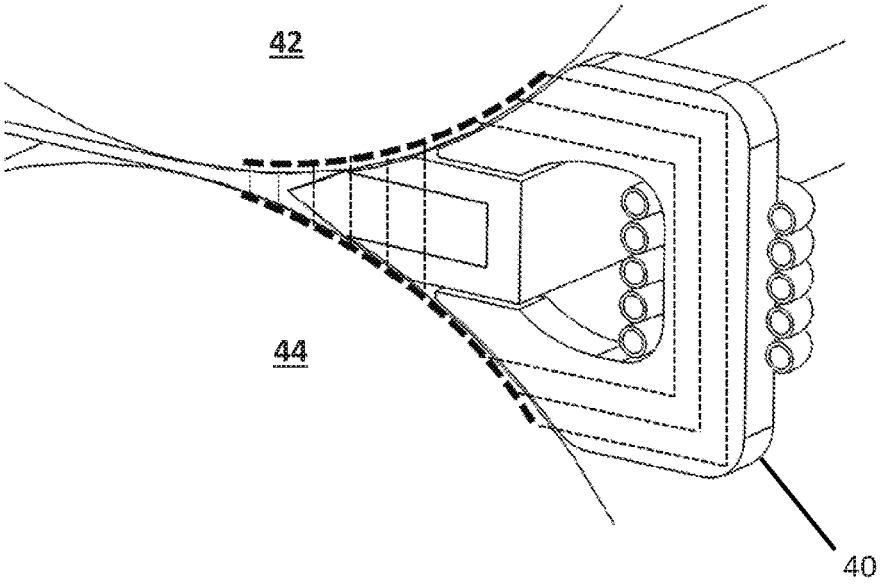
Fig. 4 PRIOR ART
FIG. 4 shows a schematic perspective partial cross sectional view of the EM edge dam arrangement of McBrien and Allwood (2013).

Both EM edge dam designs are unsuitable for rapid and large variations in width because they cannot easily be moved transversely along the rolls without impacting liquid metal. A different geometry was proposed by McBrien and Allwood (2013), and this design is shown in FIGS. 3 and 4. Like the Whittington EM edge dam, a horseshoe-shaped electromagnet 40 is used, but rotated by 90° and located behind the feed tip, pointing in the casting direction C. The horseshoe is profiled to fit around the feed tip and to direct the magnetic field into the roll bite area via the surface of the rolls 42, 44, allowing for it to move transversely (parallel to the rotational axis of the rolls) directly to control width. This EM edge dam design was tested at frequencies of 5 kHz and 15 kHz with a low melting point alloy, and it was suggested that a lower frequency was required to increase flux density at the roll bite to improve strength and stiffness of containment.

Beyond containment, the interaction of EM fields and liquid metal can be used to produce a wider range of effects. In a review of industrial applications, Li (1998) identified uses in transporting metal (valves, brakes, and pumps), stirring to distribute solutes (in continuous casting of steel) or for melting metal. In industry, the use of EM for containment is primarily through EM fields replacing copper moulds in the DC casting process, where the alternate cooling conditions and stirring create a more uniform microstructure so that scalping of the cast billet to remove the surface is reduced. The CREM ('tasting, Refining, Electro-Magnetic') process described by Vives (1989) and the 'Electromagnetic Roll Casting' process by Mao (2003) both use the stirring effect of lower frequency magnetic fields (10-50 Hz) to refine the microstructure of the cast metal.

Applied at the solidification point, stirring disrupts the solid-liquid interface and distributes nucleation sites widely. In both cases, the grain refinement observed was no better than that achieved by adding a dedicated grain refining additive.

The McBrien and Allwood (2013) EM edge dam design consists of a 4.75 turn copper coil, and a horseshoe-shaped core that fits around the caster feed nozzle. See FIGS. 3 and 4. The core 40 has profiled ends 46, 48 that match the roll radius so that flux 50 can be effectively linked into them. The magnetic field lines are concentrated through the core and directed into the ferromagnetic rolls, forming a loop by jumping across the air gap between them. As with the Whittington (1998) design, the field in the air gap provides containment of the liquid metal. This EM edge dam may be moved parallel to the rolling axis of the rolls to achieve the desired width changes.

The EM edge dam design of McBrien and Allwood (2013) is constrained by several external factors. It must fit within an existing lab scale twin roll caster, and is therefore subject to constraints in roll radius and material. A Statipower BSP12 power supply, which has a suitable current rating (up to 3000 A) and operates in approximately the correct frequency range (15-30 kHz) was used for the preliminary trials reported in McBrien and Allwood (2013). A further geometry constraint is the height of the feed nozzle, which depends on the sheet thickness and the need for sufficient insulation to prevent freezing.

The EM edge dam of McBrien and Allwood (2013) used a core made from an experimental material manufactured by Fluxtrol Inc, 'FLUXTROL EM' flux control material. It is an iron doped plastic, which reduces internal heating due to eddy currents created in the oscillating magnetic field. Despite this, cooling is still required. An internal water flow is provided via cooling channels (not shown) machined on the inner surface of both halves of the core. These halves are glued together to provide a seal, with water fed in through hoses at the back of the core.

The base for the experiments in McBrien and Allwood (2013) is a representation of the area of the twin roll caster that has an important effect on the distribution of the magnetic field. Two experiments were carried out; firstly, measurements of the magnetic field were made, and secondly the edge dam was tested with liquid metal to determine the limit of pressure that could be contained.

To measure the magnetic field, a search coil was constructed with a copper wire wound around a ceramic former. The average flux density through the coil can be inferred from its area and open circuit voltage. With the EM edge dam held statically, the search coil was placed at various positions between the rolls to measure the distribution of the flux density.

Figure 5:
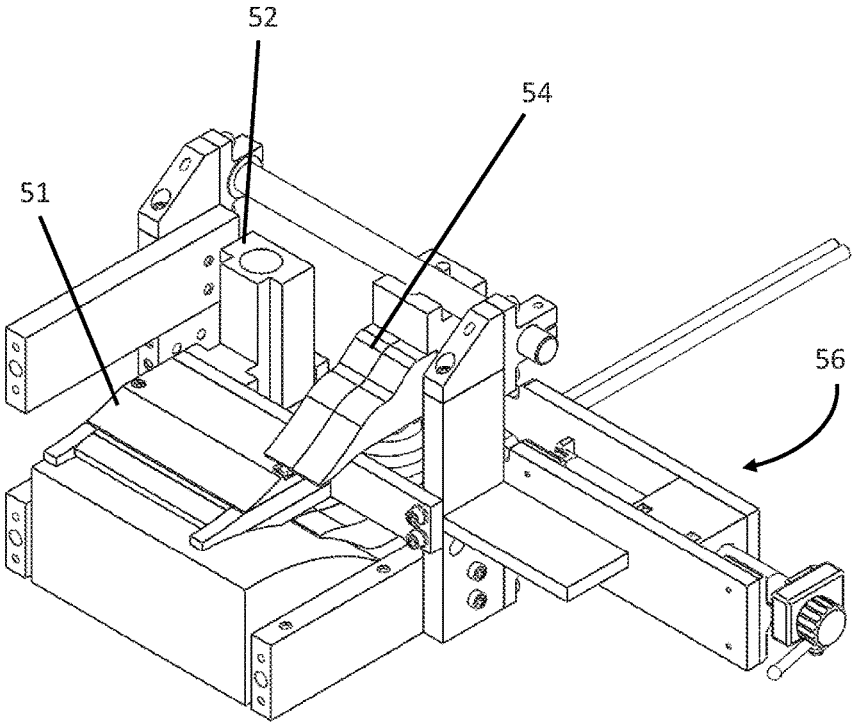
Fig. 5 PRIOR ART
FIG. 5 shows a schematic perspective view of the experimental arrangement used in McBrien and Allwood (2013) to determine the static pressure of molten aluminium retained by the EM edge dam.

Wood's metal, which melts at 70° C., was used to verify the EM edge dam's performance with liquid metal. Referring now to FIG. 5 (in which the rolls are not shown), a fixed volume of Wood's metal fills a ceramic nozzle 51 from a polycarbonate reservoir 52, with the roll gap plugged and sealed at various offsets from the roll bite. The EM edge dam 54 is moved between the rolls, via actuator 56, applying a magnetic pressure to the Wood's metal and causing it to flow back into the reservoir. The pressure head increases up to the limit that can be applied by the EM edge dam, and the relative motion of the metal and EM edge dam indicates the stiffness of the edge dam.

The experimental results of the magnetic field distribution measurements and the static pressure containment tests are described below. The EM edge dam was operated at 384 A and 16.3 kHz.

Measurements of the magnetic field distribution indicated that the edge dam has a low stiffness.

The maximum pressure determined in the static pressure containment tests is equivalent to approximately 5 mm of aluminium.

The experiments reported in McBrien and Allwood (2013) shows that the operation of the system would be affected by the flux density near the roll bite, limiting the overall pressure that may be contained, and the stiffness of the EM edge dam, affecting the stability of the edge during casting.

The flux density, and therefore the pressure that may be contained, attenuates with distance from the EM edge dam core. A number of options exist to increase roll bite flux density; current to the EM edge dam may be increased to increase the strength of the field everywhere. With the design set out in McBrien and Allwood (2013), saturation of the core will limit the gain beyond a current of approximately 800 A, and a higher current will generate more heat in the core, increasing cooling requirements or limiting the operation time. A more attractive option is to reduce the frequency of operation, which increases the thickness of the skin effect in the rolls allowing more flux to be carried. With current increased to 800 A and frequency reduced to 3 kHz, a roll bite flux density of 60 mT may be achieved, generating a magnetic pressure equivalent to 30 mm AI head. This is low, but sufficient for horizontal twin roll casting operations.

Low stiffness of the EM edge dam is an inherent disadvantage of this geometry because of the orientation of the EM edge dam. With a requirement for the ability to execute large changes in width, this would appear to be the only possible orientation and therefore the low stiffness must be accepted. In practice, low stiffness may cause oscillations in the edge position during casting and limit the rate of change of width when changing between sheets of different sizes. To mitigate this effect, a low overall pressure in the liquid metal would be required, which will reduce heat transfer to the rolls and potentially the stability of the casting process.

Further experimental work has been carried out in order to show how relatively rapid changes in the width of the cast strip can be achieved.

The experiments were carried out on a lab-scale horizontal TRC. The caster is a smaller version of industrial scale units, with small diameter rolls (320 mm) and a narrow working section (120 mm sheet width compared to 2000 mm for the largest industrial casters). The rolls are made from H13 hot working tool steel, which has magnetic relative permeability around 680 (Smithells Metal Reference, 2004). The primary use of this caster is to conduct metallurgical experiments which require an undeformed microstructure, so it is designed with a low stiffness. The top roll can move upwards so as not to apply a large rolling force, meaning the strip microstructure is as close to the as-cast state as possible. The EM edge dam and other equipment were designed specifically to fit this caster.

The EM edge dam 60 is a copper coil wrapped around a flux concentrator made from FLUXTROL 100, flux control material. FLUXTROL 100 is an iron-doped plastic which has a relative permeability of 120 with reduced heat generation due to the minimisation of eddy currents. Despite this, the core must still be water cooled via an internal channel. As shown in FIG. 4, the concentrator geometry is profiled to direct flux into the roll surface where it is carried forward towards the roll bite, and fits around the feed tip. The transverse position of the EM edge dam is controlled via a linear actuator.

Figure 6:
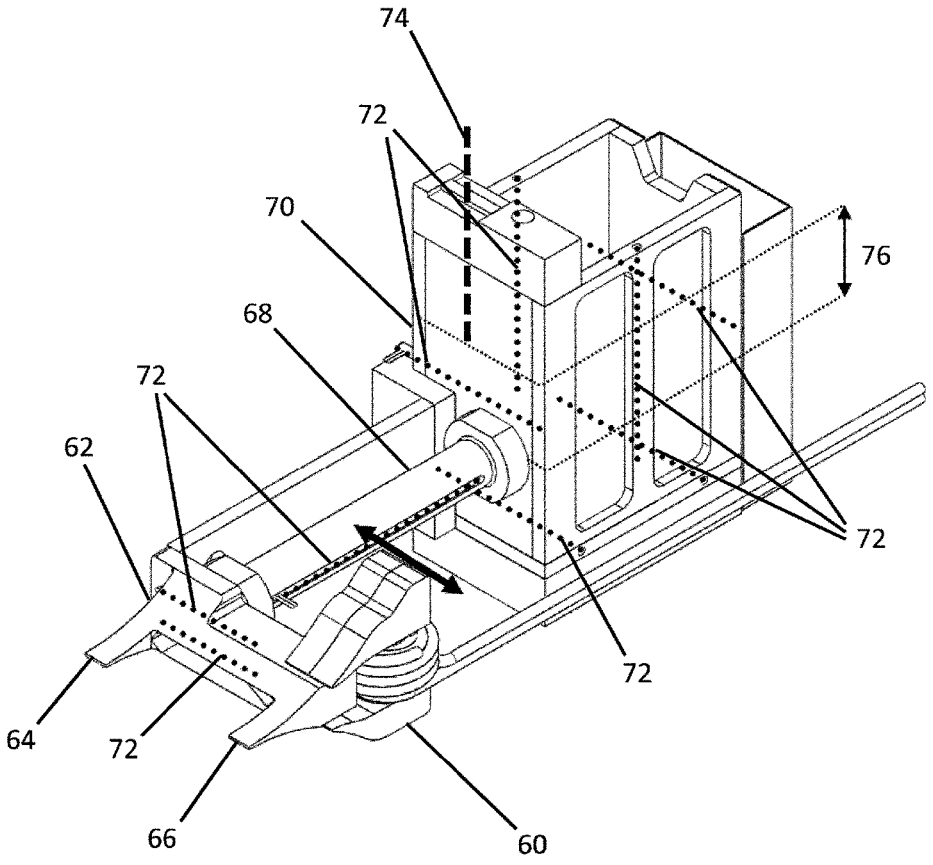
FIG. 6 shows a schematic perspective view of an experimental arrangement used in the present work, showing the feed system and the EM edge dam.

The feed system and the EM edge dam are shown in FIG. 6. The feed tip 62 must be non-conductive and non-magnetic so as to be transparent to the magnetic fields generated by the EM edge dam. It is made from N17, a calcium silicate refractory material which is commonly used in TRC feed tips. The feed tip was designed to be as thin as possible so that the EM edge dam could be placed closer to the roll bite, thereby increasing the strength of the magnetic field along the sump. Two mechanical edge dams 64, 66 are integrated in the feed tip—one to provide containment on the uncontrolled edge, and one beside the EM edge dam for use during start-up and to provide a failsafe situation if the EM edge dam switches off.

The target width variation is from 50% to 100% of the width of the feed tip opening (65 to 130 mm). To allow the required EM edge dam motion, the liquid metal feed into the tip is asymmetric. The inner profile of the feed tip is tapered to encourage even flow across the width. Once a blockage from already-solidified strip is established during casting, the liquid metal fills the entire tip. The liquid metal is fed via a feed tube (also made from N17) from a stainless steel reservoir 70 which is far enough from the EM edge dam so as not to affect the distribution of the magnetic field. The entire feed system is preheated with cartridge heaters 72 inserted in machined holes in each part. Low powers are used for the feed tip 62 and feed tube 68 (2×100 W heaters in each part, 400 W total) because the N17 is an effective insulator and has a low thermal mass, while the reservoir 70 has more heaters and a higher power to compensate for more heat being conducted away (6 heaters, 1400 W total). The temperature of the liquid aluminium as it is delivered to the caster may be varied by changing the preheat temperature and/or time, or by varying the superheat of the liquid aluminium at pouring.

The metallostatic pressure of the liquid aluminium, which balances with the applied magnetic pressure from the EM edge dam, is set by the height of the liquid metal surface in the reservoir (with small flow rates and a low viscosity, pressure loss in the feed tube is ignored). An OptoNCDT-1302 laser distance sensor 74 is user to measure the pressure head, and the head may be controlled manually by varying the pouring rate during casting. Reference number 76 indicates a change in height of the liquid metal surface in the reservoir.

Figure 7:
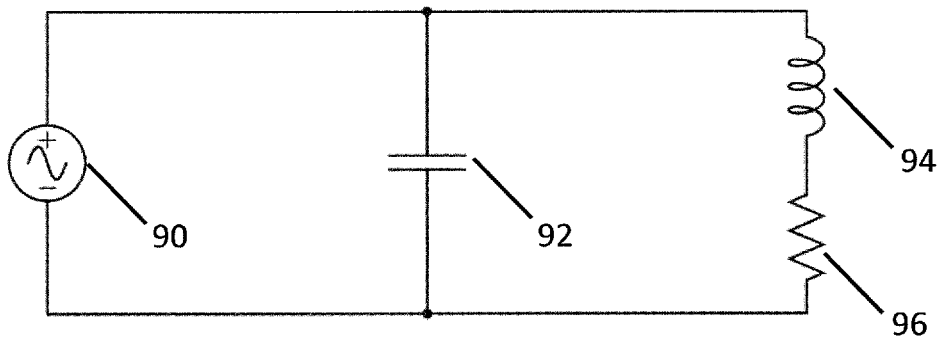
FIG. 7 shows a circuit diagram to illustrate a parallel-resonant combination of inductor (the EM edge dam) and capacitors that magnify the signal from a signal generator used in a power supply to provide the current to an EM edge dam used in the present work.

A recommendation from previous testing with the EM edge dam concept was to operate at a lower frequency, in the range 1-3 kHz, in order to boost the strength of the field at the roll bite. With no off-the-shelf solutions of suitable specification available, a custom power supply was manufactured. This consisted of a signal generator and industrial amplifier which together produce a sinusoid output voltage. The amplifier 90 was an AE Techron 7700 (max 75 Vrms, 1.2 kHz). A parallel-resonant combination of inductor (the EM edge dam) and capacitors magnify the signal to give a high current into the EM edge dam. Capacitors 92 were 12×47 μF in parallel, giving a total capacitance of 564 μF. The EM edge dam, represented schematically by inductor 94 and resistor 96, had an inductance of 24 μH and a resistance of 20 mΩ. A circuit diagram is given in FIG. 7. The values for inductance and capacitance were chosen for resonance at approximately 1.2 kHz.

The purpose of these experiments is to prove and quantify the operation of the EM edge dam in varying width, to identify which parameters or physical effects are important, and to check the quality of the cast strip. Initially, commissioning trials were necessary to determine the best setpoints for the new equipment for reliable casting. The EM edge dam was tested first of all as a static edge dam, aiming to maintain a constant width, and then as a dynamic unit aiming to change width. The step response of the EM edge dam was obtained by holding the magnet stationary and switching it on and off, observing the change in width, and then controlled width variations were attempted by moving the EM edge dam transversely, with and without variation of the pressure head.

The mechanical properties of the cast sheet were checked with tensile tests and hardness measurements, and the samples taken for metallographic analysis.

A finite element model was created in COMSOL AC/DC module to calculate the distribution of the magnetic field in the area between the rolls. The model calculates how the field interacts with the rolls and representative aluminium feed geometry, including the skin effect excluding the magnetic field from inside the conducting metals. The model assumes a shape for the free aluminium surface rather than solving the coupled problem of magnetic field distribution and fluid pressure/surface tension. It was previously verified through measurements taken on a mock-up section of the twin roll caster in experiments described in McBrien and Allwood (2013) and is used here to explain the observed effects on aluminium movement.

Starting from established successful casting trials with the TRC, the casting parameters given in Table 1 were found to give reliable cast strips with no breakouts or premature solidification in the feed tip. To avoid sticking, the alloy chosen has a 2.5 wt % Mg content and the rolls were painted with a graphite lubricant before casting. The alloy was prepared from pure aluminium and magnesium beforehand, mixed and allowed to homogenise for one hour before casting, and the oxides removed by skimming the surface just before pouring.

TABLE 1

Casting parameters

| Parameter | Value |
|---|---|
| Alloy | Al-2.5 wt % Mg |
| Liquidus temp. | 650° C. |
| Solidus temp. | 605° C. |
| Pouring superheat | 40° C. |
| Preheat temp.-reservoir | 660° C. |
| Preheat temp.-feed tube | 800° C. |
| Preheat temp.-feed tip | 800° C. |
| Preheat time | 1.5 hrs |
| Feed tip setback | 43 mm |
| Roll speed | 1 rpm |
| Nominal roll gap | 3 mm |
| Caster preparation | 400 grit emery paper & graphite powder lubricant |

Temperature measurements taken in the feed tip indicated that heat loss was higher than expected, so a pouring superheat of 40° C. was used to compensate. The preheat temperatures were on the limit of the capabilities of the cartridge heaters but with sufficient preheat time a steady state could be reached.

The roll speed was set at 1 rpm, and with a nominal roll gap of 3 mm produced a strip of thickness 4-5 mm at a linear casting speed of 18 mm/s. This indicates that the solidification point is sufficiently offset from the roll bite to ensure the casting is not prone to liquid breakouts. Using the mechanical edge dams that are part of the feed tip, a strip of width 130 mm was produced and some edge cracks were typically observed.

Figure 8:
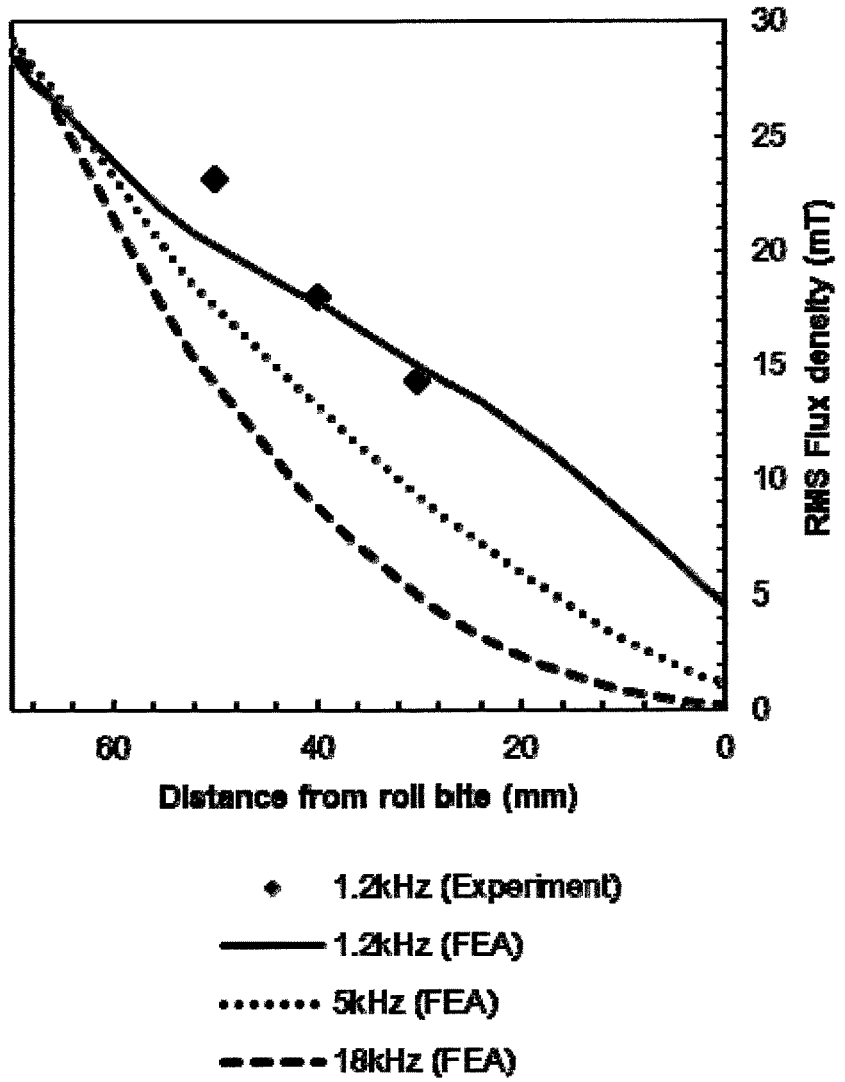
FIG. 8 shows a graphical comparison of magnetic field measurements from earlier low frequency tests and the power supply used in the present work (1700 At applied to EM edge dam for all frequencies). FEA stands for finite element analysis.

The EM edge dam was tested independently of the feed system initially. The limit of its operation was how long the output signal could be maintained before the amplifier overheated and tripped. Operation at 170 A output (equivalent to 1400 At applied to the 8-turn EM edge dam) and 1.2 kHz for 3 mins was possible. Flux density measurements were taken at points on the centreline of the core projecting towards the roll bite, and together with FEA results a comparison is made in FIG. 8 between the magnetic field from the custom power supply unit and the higher frequencies used previously. Because the frequency is lower, the magnetic field is carried further in between the rolls so is stronger in the area where final solidification occurs. The flux densities measured indicate a magnetic pressure from 6 mmAI at the feed tip exit up to 15 mmAI closer to the EM edge dam. These values increase in the presence of aluminium, as the magnetic field lines tend to bunch around the aluminium edge.

It is possible to boost output by using a more powerful amplifier or two amplifiers in parallel, giving a stronger magnetic field. From previous experience with the higher frequency power supplies, the limit is either the heat generation in the core or saturation of the core material. Taking these into account, with the increased amplifier power the magnetic field strength can be increased by a factor of two and therefore the pressure would be four times larger, based on Equation (1) above.

Figure 9:
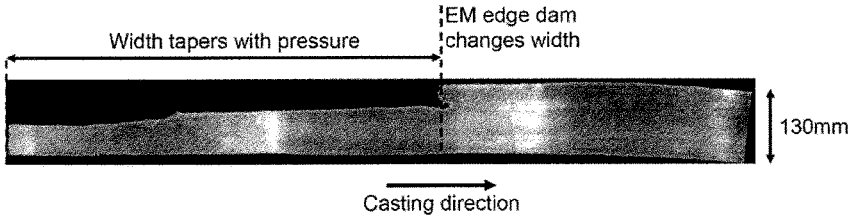
Figure 10:
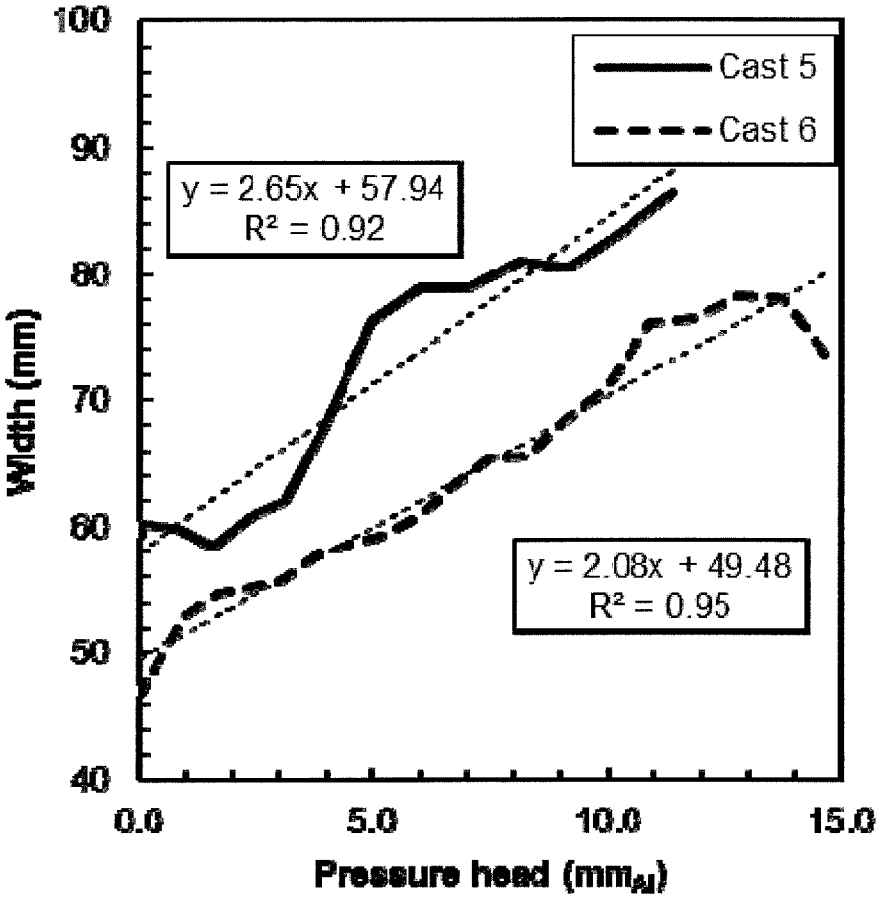
FIG. 10 shows a stiffness plot of the EM edge dam when stationary, including lines of best fit for the data.

The EM edge dam was demonstrated by holding at the centreline of the feed tip and using to cast a sheet of approximately half the width of the mechanical edge dams. In these trials, the metal was poured before switching the EM edge dam on, so pressure head decreased as the metal ran out. A tapering of the width was observed, as shown in FIG. 9, and is used to infer the stiffness of the EM edge dam by plotting width against pressure head in FIG. 10, which shows data for two separate casting runs. The stiffness is approximately 2.1-2.7 mm of width change per mm of change in pressure head per both casts, giving an indication of the accuracy of pressure control required to use the EM edge dam for casting at constant width. The plots also show that for identical applied current, pressure head, and casting conditions, the strip width varies by 10 mm, indicating that the response of the EM edge dam is not perfectly repeatable.

Figure 11:
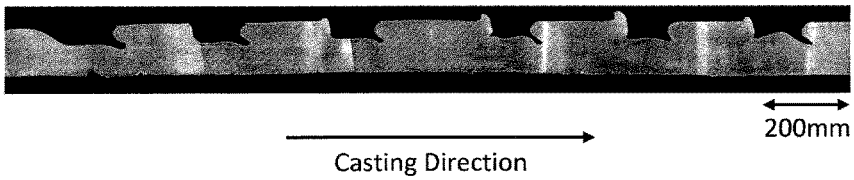
FIG. 11 shows a view of a cast strip and the effect on the width when the EM dam is switched on and off repeatedly.

The step response of the EM edge dam was measured by switching current on and off while holding the EM edge dam stationary, again with the centre aligned with the centre of the feed tip. The strip produced is shown in FIG. 11. Switching the EM edge dam on causes an initial decrease in width from 130 mm to approximately 75 mm, and there is a slight rebound before settling. A 'tail' feature can be observed on all vertical trailing edges. When switching the EM edge dam off, the width returns to 130 mm, in some cases with a brief overspill beyond the feed tip. There was a delay of approximately 5 s between turning power on and the observed width reduction, but when switching the EM edge dam off the response was immediate. This suggests that the mechanisms of increasing and decreasing width are distinct, and is explored further in the discussion below.

Figure 12:
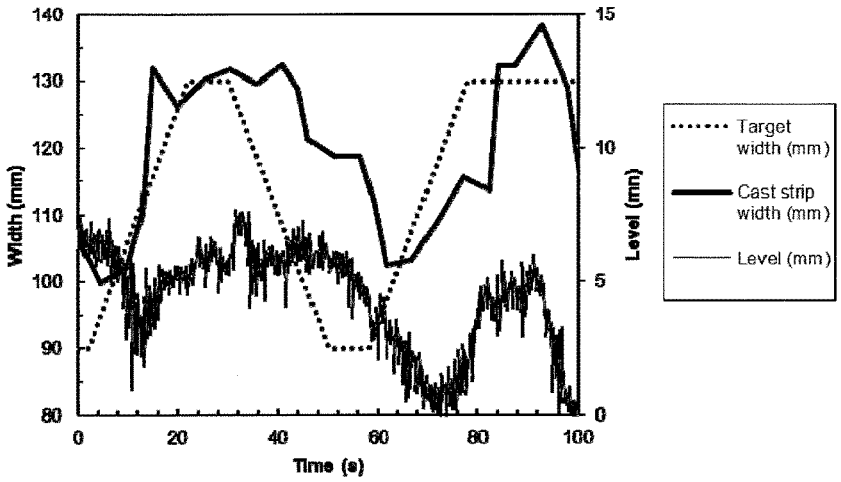
FIG. 12 shows measurements of cast strip width with moving EM edge dam and variable pressure head, compared with a target width.

A final set of casting trials were carried out with a moving EM edge dam, aiming to change the width from 90 mm to 130 mm and back again through ramp motions at a speed of 2 mm/s. The most accurate result achieved is shown in FIG. 12. The target width is calculated from the motion of the EM edge dam, while the real width was taken via direct measurements on the cast strip. Also given are the measurements of the pressure head taken with the laser. With some manual perturbation of pressure head by changing the pouring rate, the sheet width follows the same shape as the target. The change in width of the strip is approximately 30 mm for a 40 mm movement of the EM edge dam. Again, there is a delay observed between the action of the magnet and the decrease in sheet width, while increasing width is almost instantaneous.

Figure 13:
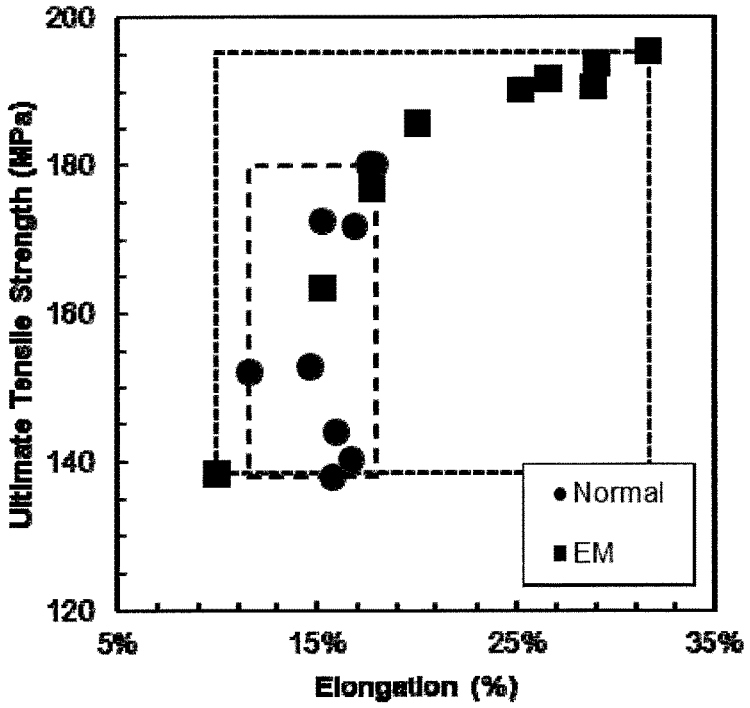
FIG. 13 shows the spread of ultimate tensile strength and elongation for tensile test specimens with and without EM edge dam (tested according to ASTM 8557-06, 1" gauge length, 0.5 mm/min).

With the EM edge dam active, there was no discernible change in edge cracking or in the visible condition of the strip surface. Tensile test coupons were taken from strip with and without the EM edge dam active and tested according to ASTM B557-06, with the mechanical properties obtained plotted in FIG. 13. The results show that both the strength and ductility of the cast strip increase when a magnetic field is applied. However, the spread of the results is larger with the EM edge dam used, and for the worst case coupon there was a visible void in the failed surface, suggesting that the effect of the EM edge dam is unsteady. The results in FIG. 13 are from longitudinal specimens-transverse specimens were also tested and no difference in properties was found.

Figure 14:
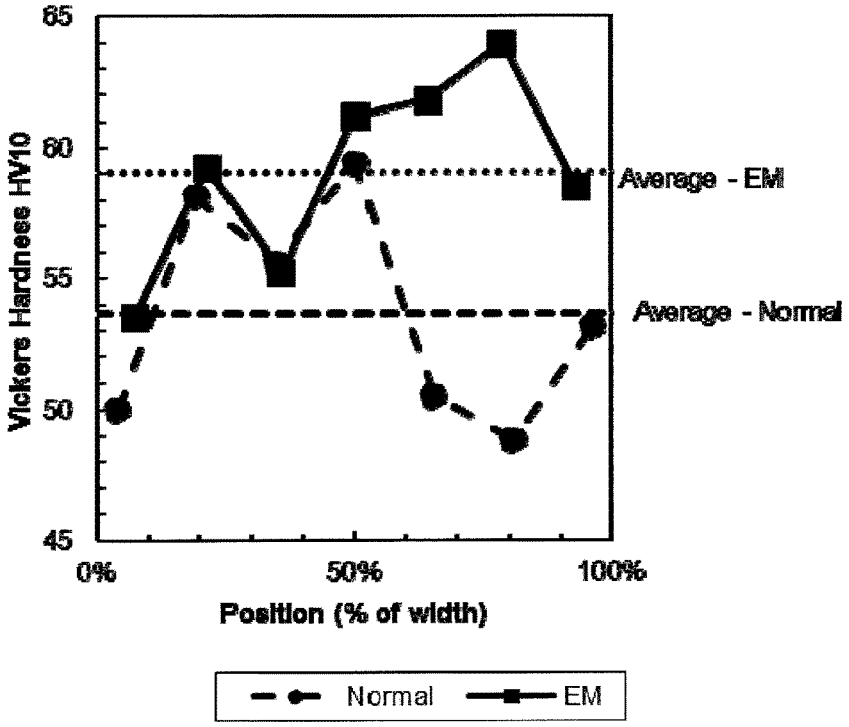
FIG. 14 shows the hardness variation across the width of normal and EM cast strip (tested according to ASTM E92-92 with a 10 kg load).

Hardness measurements were also taken across the width of the top surface of the strip at three points, with and without the EM edge dam switched on. FIG. 14 shows the averages across the width and the overall averages for the normal strip and EM edge dam. The average hardness of the aluminium increased from 53 HV to 59 HV, although from the plot in FIG. 14 we can see that like the tensile tests the values had a larger variation than the 'normal' strip. There was no significant difference in hardness across the width, indicating the EM edge dam has some effect at a distance of 60 mm from the edge.

In order to explain the apparent improvement in mechanical properties, micrographs were taken from samples comparing the normal microstructure of the strip to the microstructure with the magnetic field applied. Specimens were cut, mounted and polished and then etched electrolytically in Barker's solution, with the specimen as the anode and a stainless steel pot as the cathode, at 20V for 30 sec. Images were taken under polarised light with a tint plate.

Figure 15:
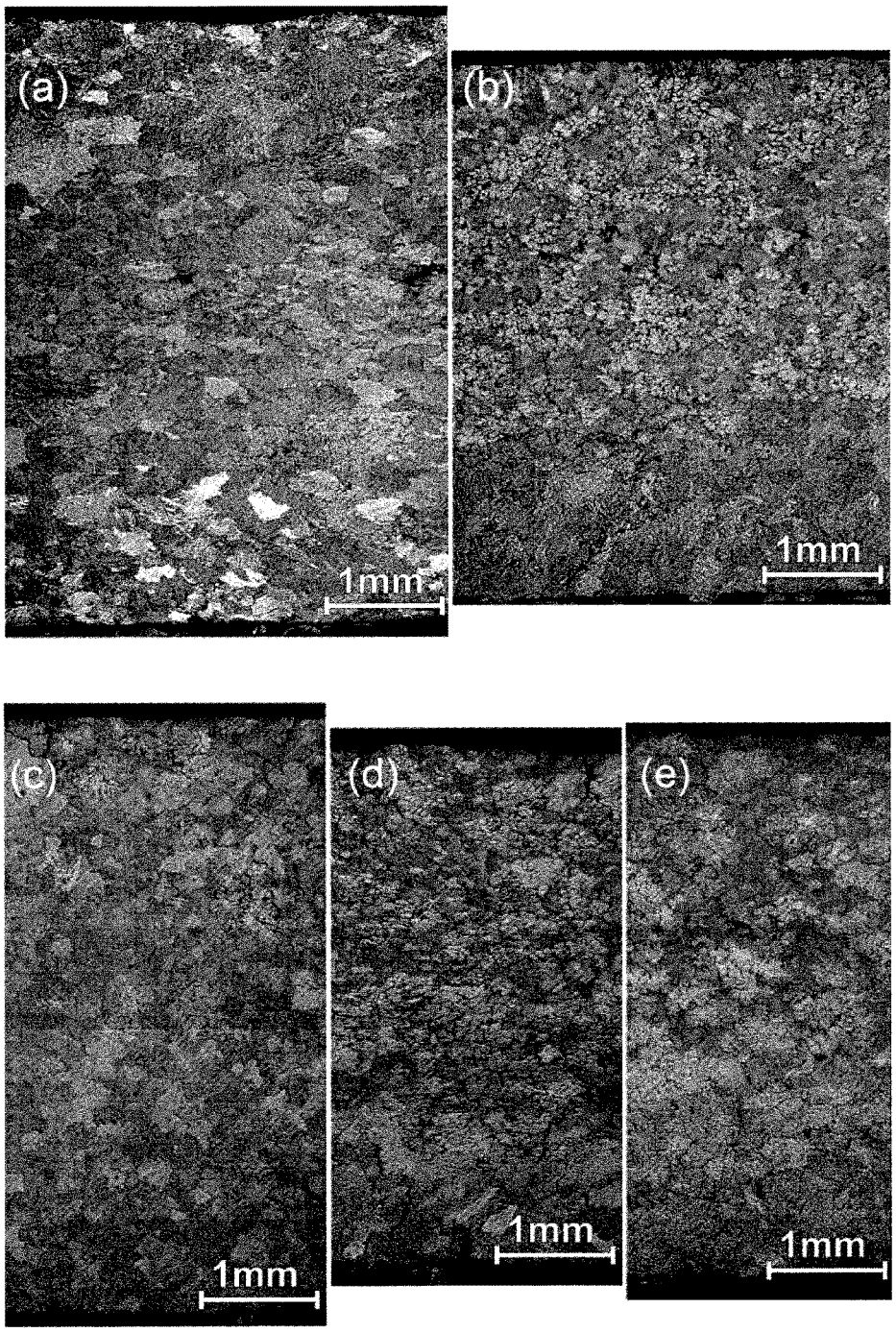
FIG. 15 shows through-thickness micrographs of cast strip: (a) longitudinal view, centreline of strip, no EM edge dam (EMED) (b) longitudinal view, centreline of strip, EMED on (c) transverse view, edge of strip, no EMED (d) transverse view, EMED on, near edge (e) transverse view, EMED on, far edge.

FIGS. 15(*a*) and (*b*) are longitudinal views examining the microstructure through the thickness for normal and EM casts respectively (note that there is a difference in thickness between samples; this is due to the reduced deflection of the caster when the strip is narrower). Both microstructures show a fine grain size at the surface where there is contact with the rolls and a very high local cooling rate, and centreline segregation at the final solidification point about ⅔ of the thickness up from the bottom surface. However, while the normal strip has large dendritic grains throughout, the EM strip shows significant grain refinement and a more rounded 'rosette' grain shape in the top portion of the strip. The bottom third section appears to be unaffected by the action of the field.

Also shown in FIG. 15 are transverse views comparing the edge of a normal strip (FIG. 15 (*c*)) with EM strip at the nearest (d) and farthest (e) edges from the EM edge dam. Again, grain refinement can be seen, but to a lesser extent further away from the EM edge dam suggesting a non-uniform affect across the width of the strip.

The results of the casting trials have demonstrated promising control of the strip width and an interesting change in the properties of the cast strip. In this section, the implications of these results are discussed.

Figure 16:
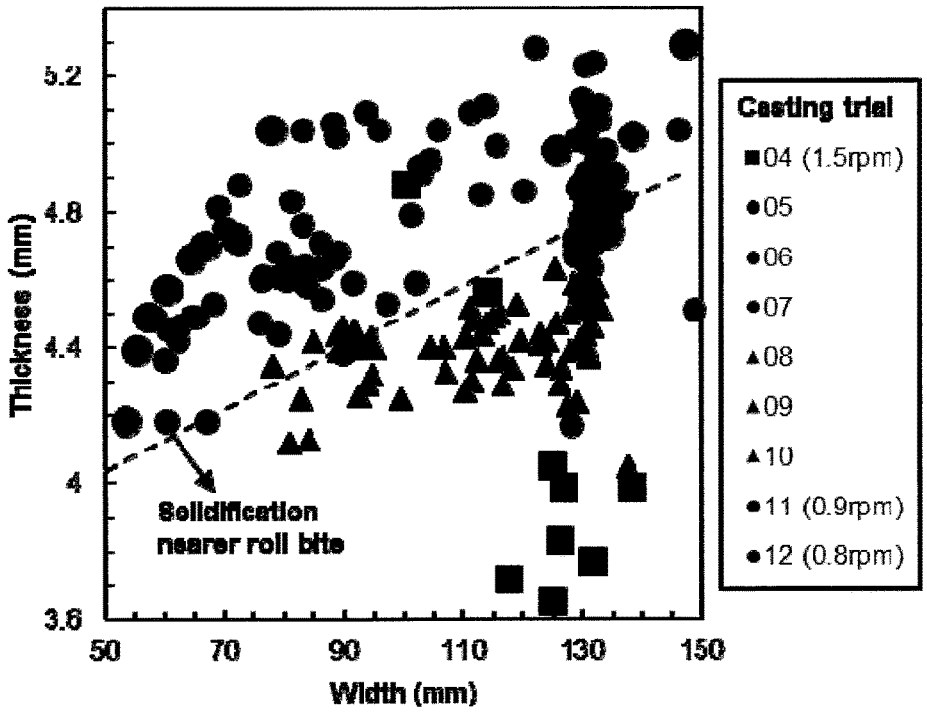
FIG. 16 shows the measured width and thickness for cast strips produced in successful (green) and unsuccessful (red) uses of the EM edge dam

Overall, the new feed system design and method of preheating worked as expected, with no problems with metal freezing prematurely and a solid strip with reasonable edge quality obtained. The asymmetry of the feed caused no issues with casting. However, there is reason to believe that the casting operation was inconsistent enough to interfere with the performance of the EM edge dam. FIG. 16 shows a plot of width against thickness for a range of points taken on different trials with the EM edge dam, with the points coloured based on whether the trial was successful (green, indicated change in width controlled by the action of the EM edge dam), unsuccessful (red, no change in width), or somewhere in between (amber, where the width changed but not correlated directly to the action of the EM edge dam).

There is a general trend where the thickness at a given width is greater for more successful trials. The ratio between width and thickness is determined by the stiffness of the caster, which is constant, and by the growth of the solidifying shells which force the rolls apart. Thicker cast sheet can be attributed to earlier solidification, closer to the EM edge dam—in this case the magnetic field is stronger so the trials becoming more successful is expected. The roll speed was varied to try to test this theory directly, and the results agreed. In casts 11 and 12, a slower roll speed was used to cause earlier solidification, resulting in a larger thickness as expected.

Therefore, the combination of caster and feed system in the setup used in this work is not repeatable enough to properly isolate the performance of the EM edge dam, which is clearly sensitive to the location of the final solidification point. It is speculated that this could be due to variations in either the aluminium temperature as it exits the feed tip or in the roll speed.

The maximum contained pressure was 15 $mm_{Al}$ (from FIG. 10) which is significantly larger than the magnetic pressure at the feed tip exit (FIG. 8), even when taking into account the boost in field strength from the presence of aluminium. The aluminium did not leak out, so there must be an additional factor aiding containment of the strip edge.

The physical effect of the magnetic field is to apply a magnetic pressure to the surface of the aluminium edge. This pressure must balance with the fluid pressure, surface tension and, in dynamic cases, inertia and viscosity. In three dimensions, the problem is complicated—the edge of the liquid aluminium forms a free surface that can change shape in profile in the feed tip, and in section along the edge. The distribution and strength of the magnetic field is coupled to this shape, and the contribution of surface tension changes depending on the contact angle with the fixed geometry of the feed tip and the moving solid shells.

Figure 17:
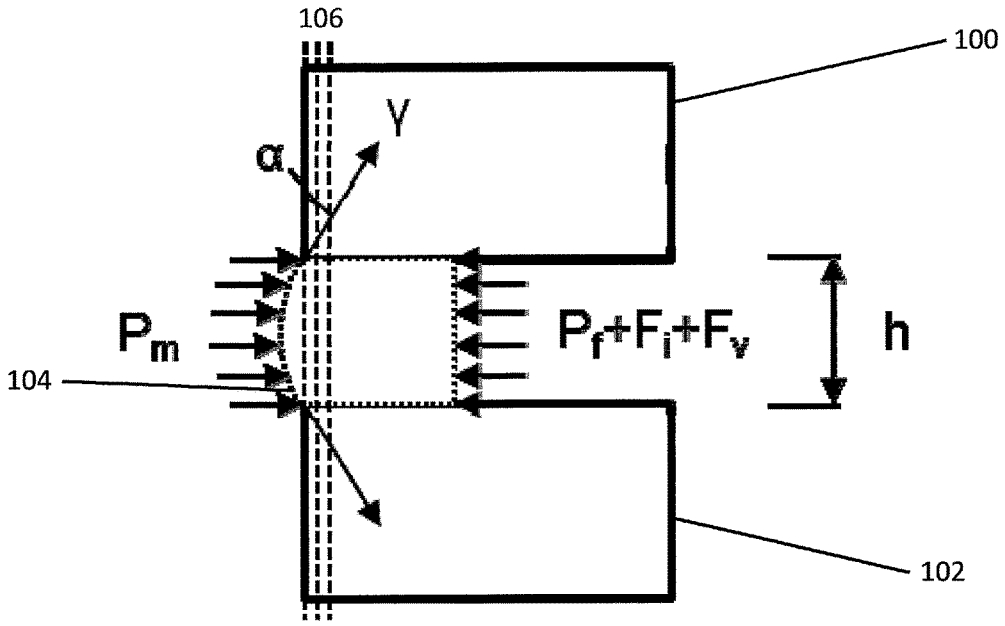
FIG. 17 shows a simplified 2D slice for modelling balance of forces during casting.

A simple 2D approximation is proposed in FIG. 17, which shows a slice transverse to the casting direction (that is, the casting direction is into the plane of the page). It is assumed that there is no variation out of plane, and that the liquid metal is confined between two solid shells 100, 102 of separation, h, with a bulge 104 to form some contact angle, α, between the liquid and solid surfaces on which a surface tension, γ, acts. The magnetic field 106 is carried vertically between the rolls and is confined to the surface of the aluminium due to the skin effect. It exerts a magnetic pressure, $P_m$, which acts to repel the strip. Finally, there is an internal fluid pressure, $P_f$, from the pressure head in the reservoir acting to push the liquid aluminium outwards from the free edge and potentially a contribution from inertia and viscous drag, $F_i$ and $F_v$ respectively, both opposing the motion of the liquid aluminium.

Considering now the implications for control of the width with a moving EM edge dam, the balance of forces varies depending on the magnet motion, and there are three distinct regimes:

- Constant width, where the inertia and viscous forces are zero and surface tension works with the magnetic pressure to contain liquid aluminium
- Increasing width—fluid pressure head overcomes surface tension, inertia, and viscosity, and the role of the magnetic field is to control the final width
- Decreasing width—the most challenging case, where the magnetic field pushes the edge inwards and must overcome pressure head, inertia and viscosity as well as replacing the contribution of surface tension to containment Clearly, the biggest challenge is to decrease the width of the strip, as borne out by the delay in response in this case during the casting trials.

For the constant width case, where inertia and viscous forces are zero, a horizontal force balance is given in Equation (2):

$$P_m h + 2\gamma \sin \alpha = P_f h \qquad \text{Equation (2)}$$

Figure 18:
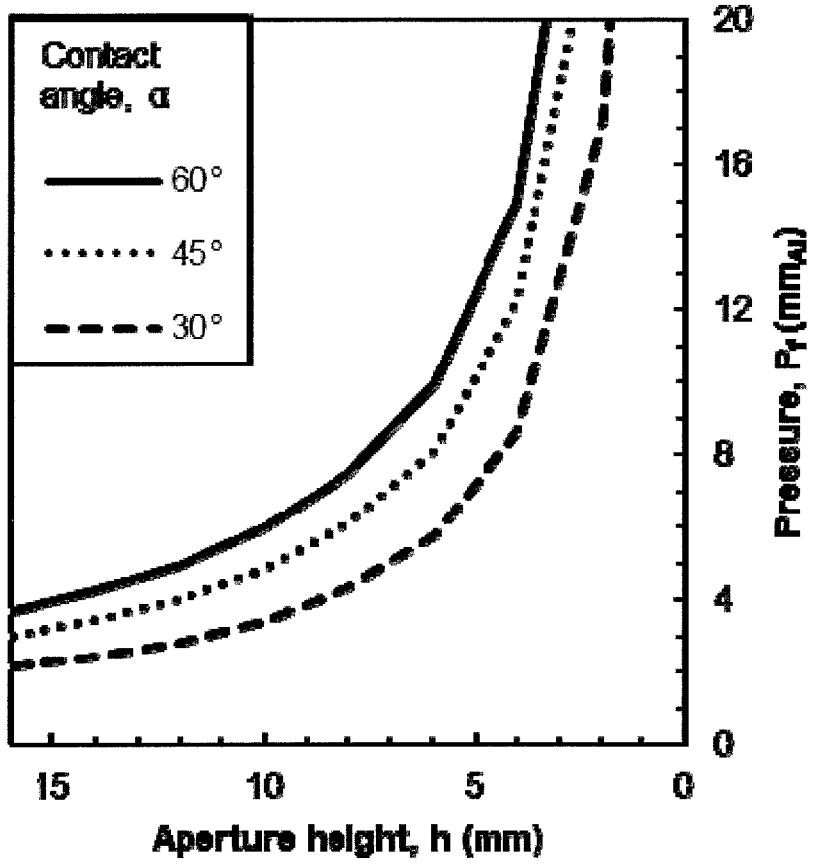
FIG. 18 shows the contribution of surface tension to containment for the model of FIG. 17.

Using Equation (2), we may determine how surface tension plays an important role in helping the EM edge dam with liquid metal containment in the sump through the plot of FIG. 18. The separation of the solid shells, h, gets smaller closer to the roll bite as the solid shells grow, and therefore the effect of surface tension in the horizontal force balance increases. At the feed tip exit, where there is separation of h=16 mm between the just-forming solid shells, surface tension may hold up to 4 $mm_{Al}$ pressure head. This increases up to the final solidification point, for example 5 mm before solidification a 20 $mm_{Al}$ pressure head can be held by surface tension alone.

If surface tension is important for static containment, then any case where the width is varying requires overcoming surface tension as well as the pressure head, inertia, and viscosity. Increasing width is relatively simple, as the magnetic field may be reduced in strength by moving or reducing the power of the EM edge dam and the pressure head increased to overcome surface tension if necessary. This explains why no delay was observed when increasing sheet width.

To decrease width, the magnetic field must push the liquid meniscus back inside the feed tip and maintain containment between the solid shells. For a frequency that gives a small skin thickness, then the solid shells will mostly act to block the field from the area that has already begun to solidify. Therefore, width change must begin inside the feed tip and there will inevitably be a delay that depends on the solidification length and speed of the rolls. A delay was observed in trials both with the moving EM edge dam (FIG. 12) and with the static, switched EM edge dam. The offset was 43 mm and roll surface speed 18 mm/s, giving a delay of 2.4 s. This is shorter than the observed delays (5-10 s), so other factors must be playing a part.

Inside the feed tip, two effects oppose motion of the liquid metal. Firstly, surface tension will act to try to maintain the minimum free surface area, which would be obtained with a straight edge from solid shell to back of the feed tip. Secondly, the inertia of the liquid aluminium and viscous drag on the walls of the feed tip must be overcome. None of the casting trials give clear evidence for the effect of surface tension, and calculating the inertial forces will depend on how the fluid flows inside the feed tip. As an approximation, we may say that if the mass flow out of the caster (which scales linearly with width if thickness and sheet velocity are fixed) is much greater than the transverse mass flow in changing width, then only a small volume of metal need be affected by the EM edge dam and inertia has only a small effect. If the transverse mass flow is large (corresponding to a rapid width change), then for conservation of mass the metal must be pushed back into the reservoir and the inertia forces are large.

Figure 19:
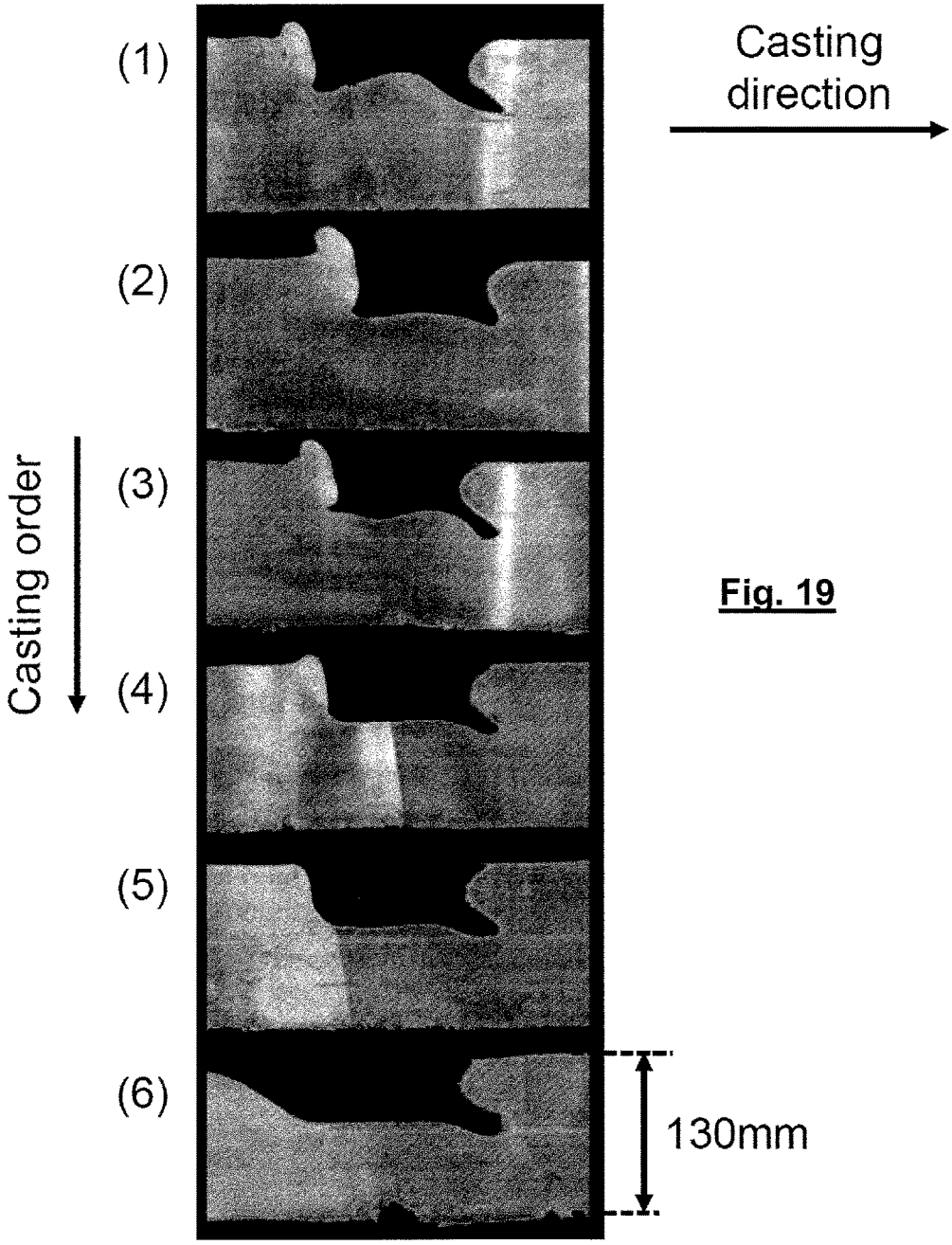
FIG. 19 shows views of cast strips and the step response of width to stationary EM edge dam input.

Now we consider varying the width by switching a static EM edge dam on and off. The step response of the strip, which showed a very rapid variation in both decreasing and increasing width, implies there is a further mechanism for controlling strip width. Rather than acting to move the edge of the strip, when the EM edge dam is switched on it divides the flow already in the feed tube. FIG. 19 shows the characteristic pattern produced in casting trials with the switched, stationary, EM edge dam, and how this pattern varies with the duration of the cast. Because the field is generated in the middle of the strip, it effectively splits the metal in the feed tip in two at the centreline. The fixed edge, on the bottom in FIG. 19, has a continuous feed of aluminium, while the feed to the top edge is blocked by the magnetic field. The remaining aluminium solidifies as a tail from this top edge, then quickly runs out leaving a strip of approximately half width.

When the EM edge dam is switched off, an overspill beyond the aperture set by the mechanical edge dams occurs briefly before the standard 130 mm strip is produced. Without the blockage provided by already-solidified strip, the liquid metal can initially flow beyond the width of the feed tip, but providing this liquid metal solidifies without leaking from the caster completely then a solid barrier is formed and the situation quickly resolves back to give a stable cast. The overspill effect becomes smaller and then disappears later in the cast, when the pressure head is smaller and the metal will have cooled, suggesting that it is possible to prevent overspill with suitable control of these parameters.

In all cases, a single oscillation of the width occurred after turning on the EM edge dam. The overshoot and final settled width vary with casting time, and because the reservoir is at a lower temperature than the poured aluminium, then a change in feed temperature is the most likely cause of this variation, and there is a common trend observed. The highest feed temperature gives the largest overshoot and widest strip, and as the temperature decreases the overshoot and width decrease down to their minimum for the final step. The feed temperature affects the solidification profile, again showing the importance of the location of the solidification point in determining the performance of the EM edge dam.

Figure 20:
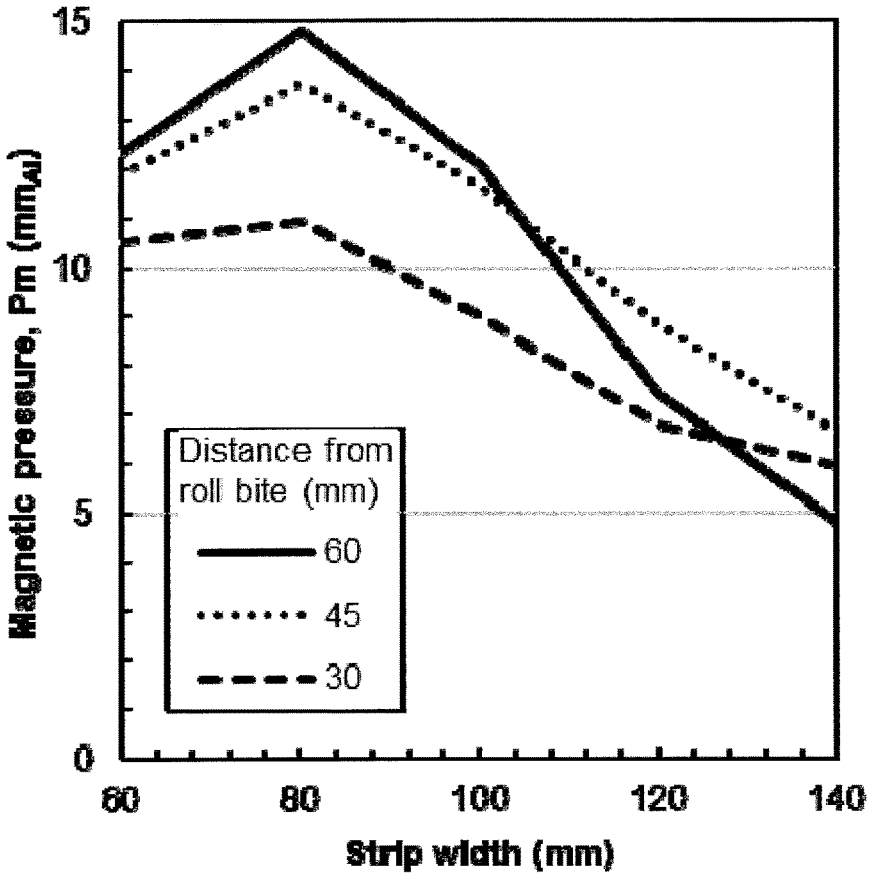
FIG. 20 shows a plot of the FEA calculation of the change in pressure on the aluminium free surface as the width changes.

The distribution of the field changes depending on the extent to which liquid aluminium fills the feed tip, with a plot of magnetic pressure at the surface of the metal against the strip width made in FIG. 20. These values have been calculated from the finite element model, with the assumption that the liquid aluminium takes a shape that completely fills the feed tip up to the width of the strip, and that the free edge is parallel to the casting direction—both of these are unlikely to be true in practice so only qualitative conclusions may be made from these results. The results shows that the magnetic pressure on the free edge is weak for a wide strip, increases to a maximum where the free edge aligns with the EM edge dam location, and then decreases again. This may explain why a rebound and settling effect is observed in the step response—the metal responds slowly at first because the field is weak, accelerates towards a smaller width and overshoots, and then because the field is weaker it rebounds to the equilibrium position in line with the EM edge dam. Assuming that this mechanism is correct, then the accuracy of the step response may be improved with control of the EM edge dam current and pressure head to damp this oscillation.

Turning now to the quality of the cast strip, it is noted that the strip should meet or exceed the requirements on normal sheet, in order for it be used to make products. In practice, this means that the EM edge dam can produce a poor quality edge, as trimming is expected, but the surface quality of the strip must be good and the mechanical properties of the sheet must exceed specifications and ideally be uniform throughout the sheet. There is no discernable change in edge cracks or surface quality, but mechanical properties are improved due to a change in the microstructure.

Figure 21:
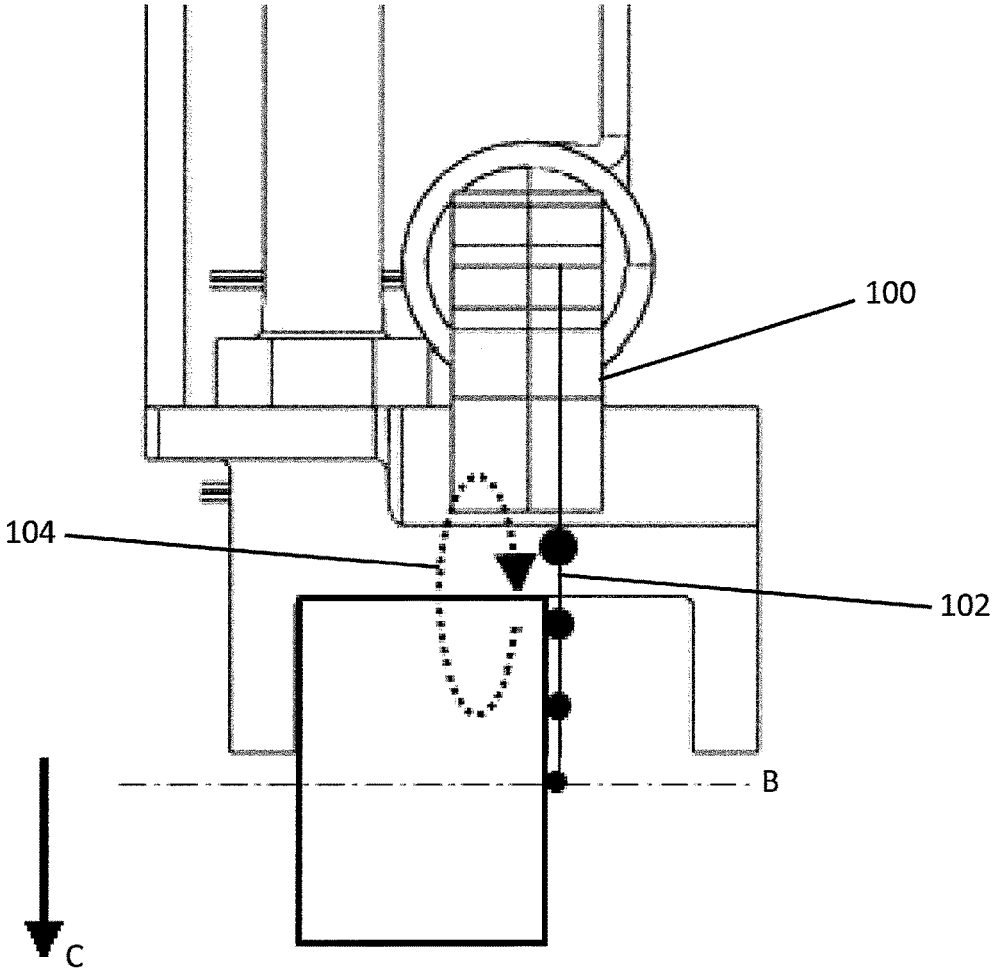
FIG. 21 shows a plan view of the apparatus of a preferred embodiment, indicating a proposed mechanism for stirring.

This change may be attributed to a stirring action of the EM edge dam. A mechanism for the creation of this stirring motion is proposed in FIG. 21. The magnetic field 102 attenuates from the edge dam 100 towards the roll bite B, and this gradient sets up a fluid flow along the edge parallel to the casting direction. By mass conservation the liquid metal must recirculate 104, giving a transverse flow of liquid aluminium at the liquid-solid interface. This transverse flow interrupts dendritic growth, distributing potential nucleation sites and produces the characteristic rosette structure observed instead. No comparison was made with the addition of grain refiner, but it appears that the EM edge dam would at least achieve parity with the mechanical properties of normally cast sheet.

The micrographs of FIG. 15 showed that the microstructure refinement occurred mostly in the top half of the strip, with the bottom third of the thickness showing little modification from the normal strip. This is likely due to differences in the heat transfer and therefore rate of solidification of the strip—because the centreline segregation is found nearer to the top surface of the strip, it is clear that the solid shell grows faster on the bottom roll than on the top, leaving less time for stirring to affect the microstructure. The difference in rate of solidification can be attributed to the details of the setup of the feed tip and the difference in contact pressure between the liquid metal and the rolls. The feed tip is fixed relative to the bottom roll of the caster, and contact between the liquid metal and this bottom roll would be immediate at the exit of the feed tip, while the top roll is deflected upwards by 1-2 mm causing a delay in initial contact. Contact pressure also varies because the pressure head is of the same order of magnitude as the thickness of the sheet, so that the top surface contact pressure is as low as half that of the bottom surface, leading to a reduced heat transfer coefficient and therefore slower solidification.

An additional point related to the mechanical properties of the strip. They were relatively inconsistent in that not all of the samples taken from the EM-controlled strip had an improvement over the normal strip. This suggests that there is an unsteady element to the stirring flow generated, which may require further work assuming that improvement of mechanical properties and not only improvement of yield (the main focus of this work) is desired.

In conclusion of this section, the proposed EM edge dam design has been successfully demonstrated to vary width in twin roll casting much more rapidly than any prior attempts, albeit without the degree of control required to make the process ready for use in practice. Casting trials with the EM edge dam have identified two ways of changing width—moving the EM edge dam transversely with a concurrent change in sheet width, or by switching a static EM edge dam on and off, which divides the flow and gives discrete step changes in width.

The switched, static EM edge dam produced a more rapid width variation, but both methods are improved with additional control. In particular, the casting process must be stabilised further due to the sensitivity of the EM edge dam performance to the solidification profile, and direct control of the pressure head together with EM edge dam position and current is necessary to achieve an accurate geometry and faster width changes.

Beyond the movement of one edge shown in these casting trials, a second EM edge dam can be used to control the opposite edge in a similar way. The electromagnet may also be positioned centrally around the feed tip and, with some modifications to the way metal is fed in, used to cast holes which would give the flexibility to cast any profile in sheet achieving the maximum possible reduction in yield loss. Because there are still edge cracks, some trimming would be needed and the yield would not be 100%, but in highly irregular products the improvement would still be substantial. A particularly suitable target application would be car body panels, although this would require some development of the twin roll casting process to improve the quality of the cast sheet.

The casting procedure disclosed here can be refined to control the solidification point more accurately, and a wider twin roll caster can be used to provide larger variations in width. The EM edge dam can be refined by increasing the output with a more powerful electrical supply (for example, using multiple amplifiers in parallel). These modifications give a more stable base from which to build a control system that links EM edge dam current and position with control of the pressure head in the reservoir in order to cast exact width geometries. The need for this control has been shown for both constant and varying width cases.

Figure 22:
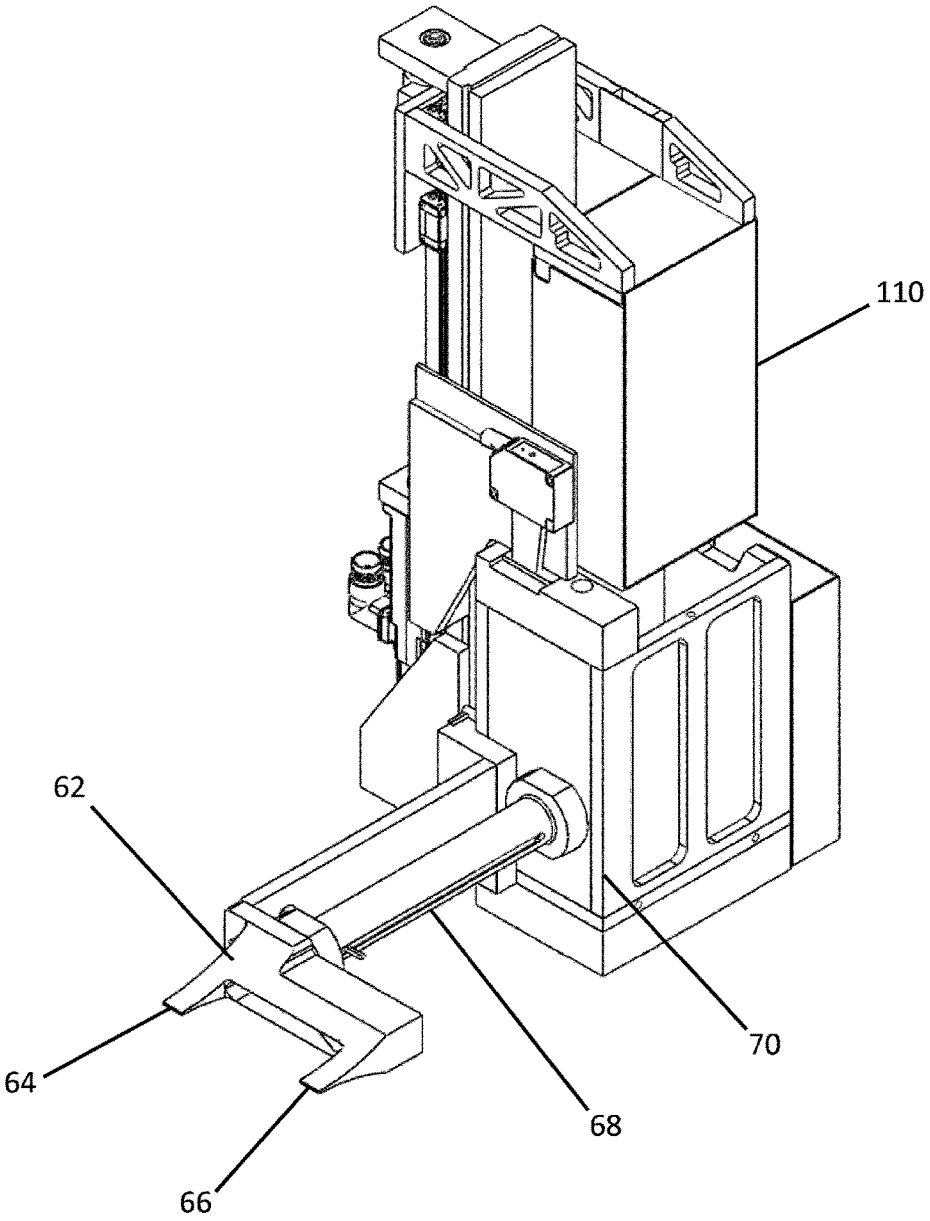
FIG. 22 shows a schematic perspective view of the molten metal feed apparatus according to an embodiment of the invention.
Figure 23:
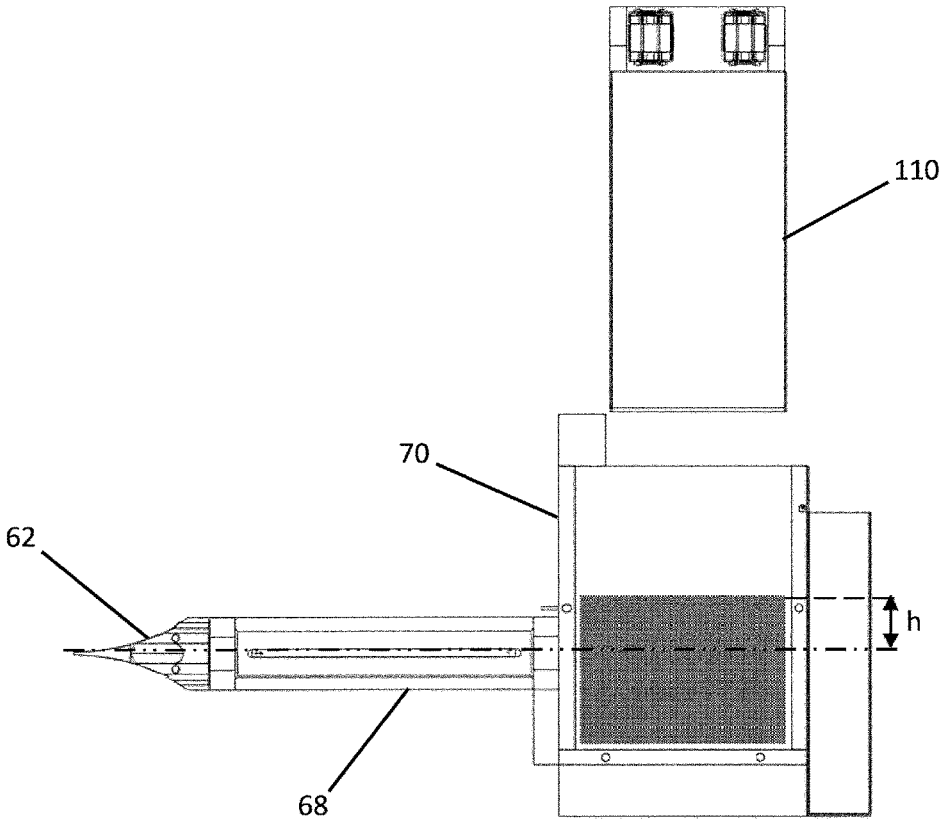
FIGS. 23 and 24 show schematic sectional views of the displacement of the molten metal level by movement of the displacement body.
Figure 24:
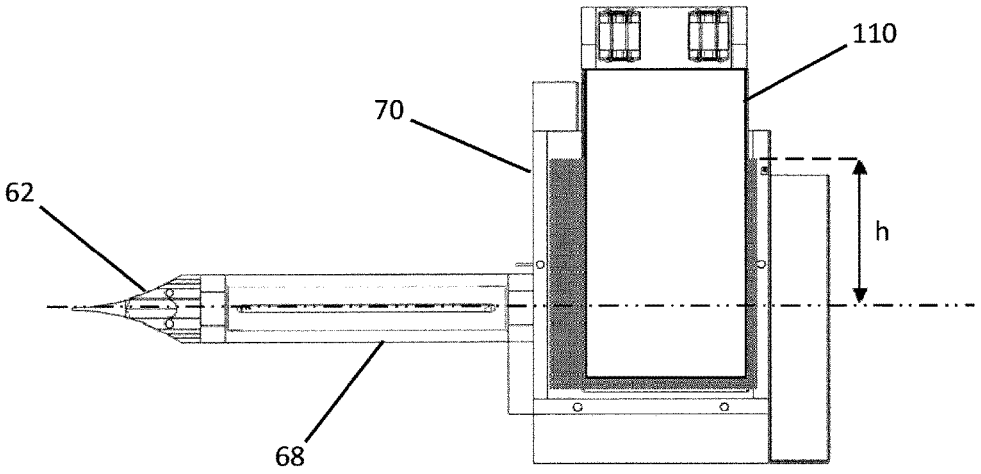

FIG. 22 shows a schematic perspective view of the casting system without the casting rolls or EM edge dam. The feed tip 62 is as shown in previous drawings, the molten metal being provided to the feed tip by a heated conduit 68 from the molten metal reservoir 70. In this embodiment, the position of the molten metal reservoir is fixed with respect to the feed tip. The level of the molten metal in the reservoir is determined by two factors. Firstly, by the amount of molten metal in the reservoir. Secondly, by the degree of intrusion of a displacement body 110 into the molten metal in the reservoir. As will be clearly understood, movement of the displacement body downwardly in FIG. 22 into the molten metal displaces some molten metal upwardly. This raises the level of the molten metal in the reservoir and increases the static pressure of molten metal in the feed tip. This is shown in FIGS. 23 and 24, illustrating schematically the increase in static pressure in the molten metal feed tip due to maximum immersion of the displacement body in the molten metal and the resultant height h of the molten metal in the reservoir above the level of the feed tip 62.

Figure 25:
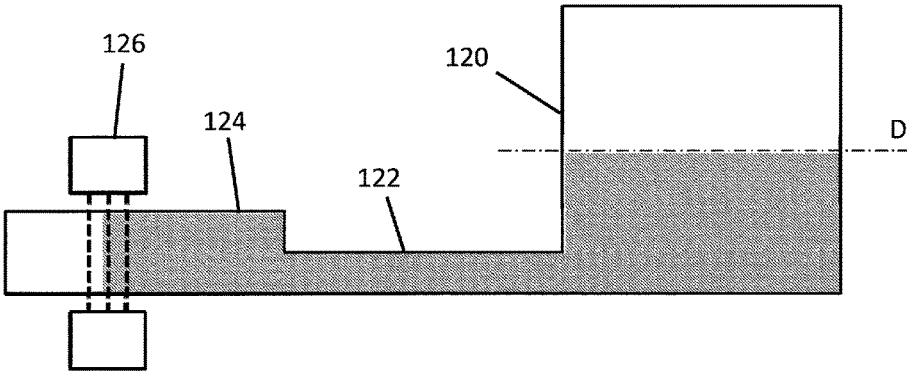
FIGS. 25-27 illustrate the interaction of EM edge dam coil current, position, and pressure head to achieve desired changes in sheet width.
Figure 26:
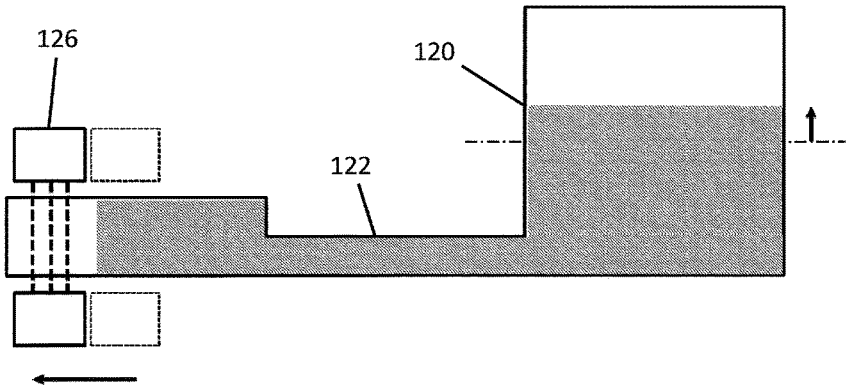
Figure 27:
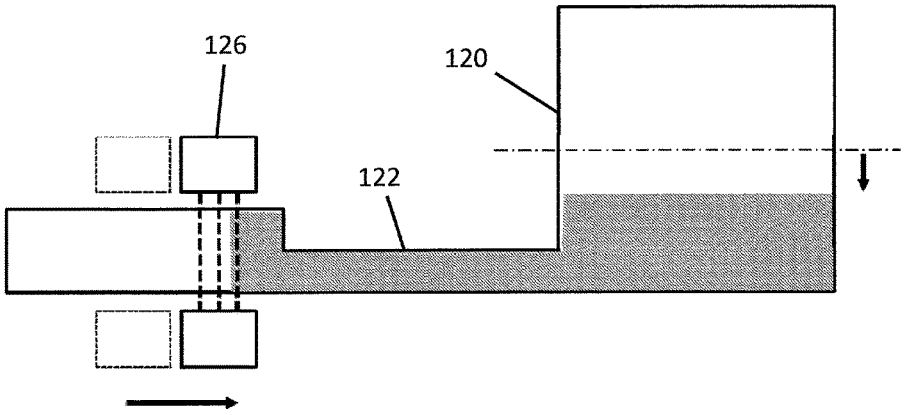

The interaction between the control of the molten metal feed pressure and the EM edge dam is illustrated in FIGS. 25-27.

Control of the position of the edge of the cast strip depends on the balance of the fluid pressure in the liquid metal, the surface tension on the liquid metal edge, and the magnetic pressure applied on the metal edge by the EM edge dam. As discussed above, the liquid metal pressure may be controlled by varying the height of metal in the reservoir compared with the height of the feed tip (known as the pressure head), and the magnetic pressure is controlled by the current applied to the EM edge dam and its position relative to the liquid metal edge.

The experimental work reported above show that linked control of these factors is important in achieving a rapid change of width with suitable control. FIGS. 25-27 show schematics of how the EM edge dam position and pressure head can be adjusted in order to achieve desired variations in width. It is noted that this approach is best suited to changes in width where the opposite edges of the sheet are moved symmetrically by EM dams at opposing sides of the cast strip. This approach can also be used where the product geometry requires asymmetric movement, however there is then a corresponding reduction in the accuracy of control of the width of the strip.

In FIGS. 25-27, the view is of a schematic cross section through the molten metal in the apparatus. However, note that here for convenience the reservoir 120 and conduit 122 are shown as being aligned with the transverse direction through the strip 124, which is the same as the direction in which the EM dam 126 is moveable. In practice, the reservoir and conduit are positioned as shown in FIG. 22, with the EM dam being moveable in a direction orthogonal to the direction of flow of the molten metal along the conduit from the reservoir to the feed tip.

FIG. 25 shows a steady state arrangement, in which the intention is to cast the strip at constant width. The molten metal is held at a desired datum level D in the reservoir (with additional molten metal added to the reservoir as necessary to maintain the molten metal at the datum level and/or with a displacement body being inserted into the molten metal to maintain the molten metal at the datum level, to compensate for the molten metal lost from the reservoir during casting). The EM edge dam 126 is held at the desired position, with constant coil current.

FIG. 26 shows the arrangement during increasing the width of the cast strip. The level of molten metal in the reservoir 120 is increased by suitable displacement of the displacement body. The EM edge dam 126 is moved in the increasing width direction. At the same time, the coil current may be reduced. The increase in molten metal pressure at the feed tip helps to fill the additional area made available by movement of the EM edge dam.

FIG. 27 shows the arrangement during decreasing the width of the cast strip. The level of molten metal in the reservoir 120 is decreased by suitable displacement of the displacement body. The EM edge dam 126 is moved in the decreasing width direction. At the same time, the coil current may be increased. The pressure provided by the EM edge dam acts to push the molten metal into a more restricted area, and the reduction in the molten metal pressure reduces the resistance to this.

In the embodiment described above, the EM edge dam is moved by physical movement of the electromagnet. In an alternative embodiment, illustrated in FIG. 28, an array of static EM dams 200, 202, 204, 206 is provided. In this embodiment, the width of the cast strip 208 is selected according to which EM dams are switched on, thereby defining the position of the EM edge dam. The illustrated embodiment shows four EM edge dams at one side of the feed tip 210. For a commercial scale TRC apparatus, the maximum width of the strip may be up to 2000 mm, which provides room for many EM dams, and therefore allows relatively fine control of the width of the strip by suitable on-off control of the EM dams. EM dams can be provided fully across the width of the feed tip or may be provided at desired positions (e.g. towards one or both edges).

Figure 28:
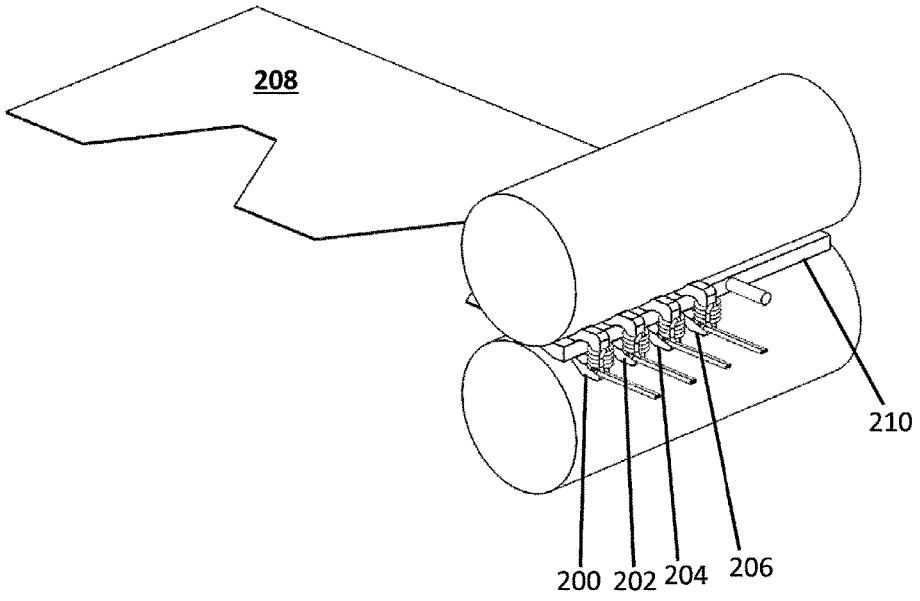
FIG. 28 illustrates an alternative embodiment using an array of static EM edge dams.

Considering the embodiment of FIG. 28 has allowed the present inventors to realise that the invention need not be limited to controlling the position of the width of the cast strip. Operation of an EM dam when there is molten metal on either side of the dam forces the molten metal apart. In this way, the EM dam acts as a diverter to divert the molten metal away from the magnetic field. The effect of this, for suitably high magnetic field strengths, is to form a hole through the molten metal feed and consequently to form a corresponding hole in the cast strip. Turning the EM field off again allows the molten metal to flow back to where it was previously excluded, closing off the trailing end of the hole. This concept of hole formation within the cast strip is, however, not limited to the use of EM dams, although EM dams may provide a particularly suitable mechanism for realising the invention. Alternatively diverters may be used, including mechanical diverters.

To achieve the minimum yield loss when casting products directly, it is easy to conceive of products that would benefit from being cast initially as blanks with one or more holes provided in them, in addition to or as an alternative to having an irregular width pattern. For example, a car door panel produced in a single piece requires an irregular width and a hole for accommodating the window. The EM edge dam can control inner edges for holes in a similar manner to outer edges for overall width. It is necessary in this case to provide a flow of liquid metal on both sides of the EM dam. In this case, the EM dam acts as a diverter rather than an edge dam.

Figure 29:
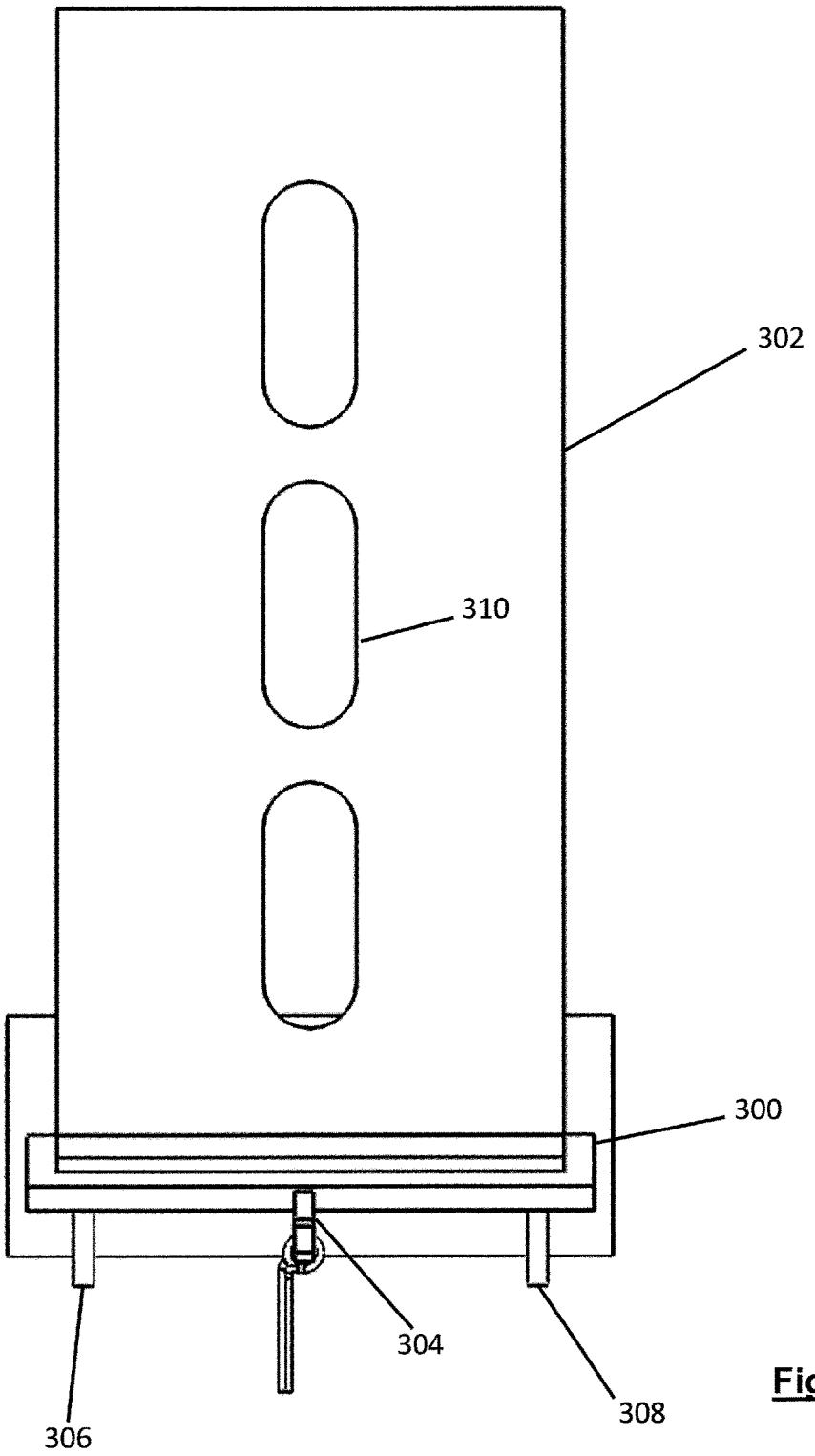
FIG. 29 shows a schematic plan view of the feed tip, cast strip and EM diverter of an embodiment for forming holes in the cast strip.
Figure 30:
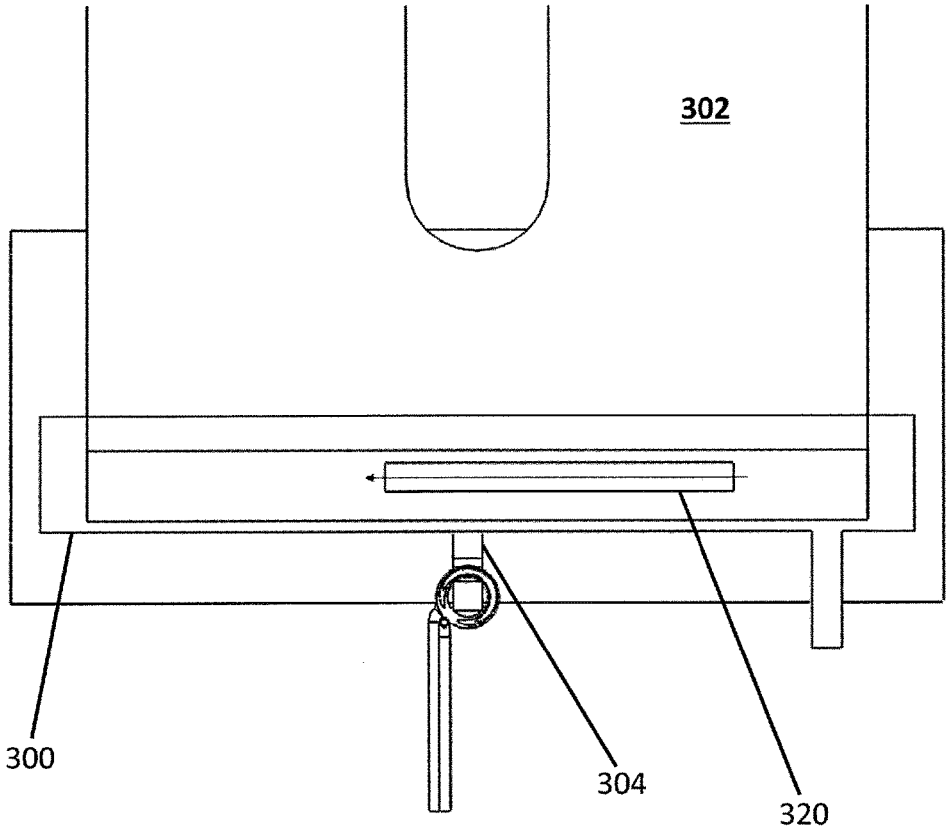
FIG. 30 shows an alternative embodiment to FIG. 29.
Figure 31:
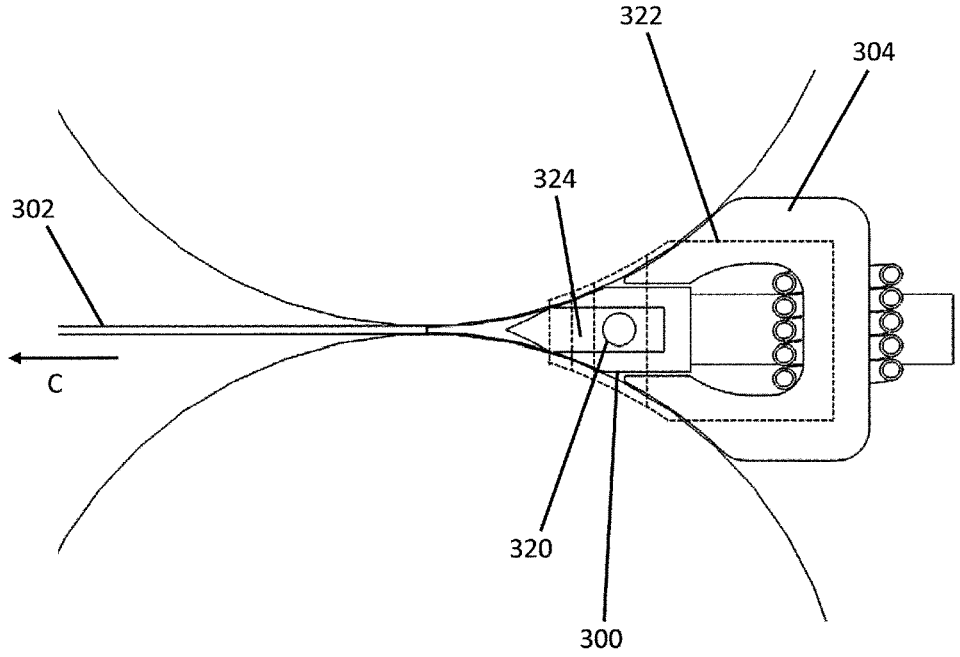
FIG. 31 shows a longitudinal cross sectional view of the embodiment of FIG. 30.

Suitable methods for providing a flow of liquid metal on both sides of the EM diverter are proposed in FIGS. 29-31.

FIG. 29 shows a schematic plan view of the feed tip 300, cast strip 302 and EM diverter 304. Each side of the diverter is fed with liquid metal by providing liquid metal independently to different locations in the feed tip, via feeds 306, 308, positioned to be on either side of the EM diverter. Holes 310 are generated by suitable operation of the EM diverter 304.

FIG. 30 shows an alternative embodiment to FIG. 29, in which a conductive tube 320 extends within the feed tip 300 and through the magnetic field generated by the EM diverter 304, so as to substantially shield the flow of liquid metal from the magnetic field within the conductive tube. This allows the liquid metal to be fed through the conductive tube 320, bypassing the EM diverter, to the other side of the EM diverter. FIG. 31 shows a longitudinal cross sectional view of the EM diverter 304, the EM field lines 322, the feed tip 300, the molten metal 324 and the conductive tube 320.

A closed hole is produced by turning the EM diverter on, holding on while the sheet is cast to generate the required internal opening and then switching off again so the internal edges can rejoin, to close up the hole.

In the embodiments of FIGS. 29-31, a variety of arrangements of EM diverters may be used. For small holes (e.g. holes of diameter up to about 50 mm), one EM diverter may be used, having the form described above for the EM edge dam. This EM diverter can be static or moveable, depending on the required position and shape of the holes. For larger holes, two EM diverters may be provided. These are preferably moveable. In effect, each provides an internal EM edge dam. Alternatively, an array of static EM diverters may be provided, as described in relation to FIG. 28, the on-off control of these allowing control of the position of the internal edge of the hole. Multiple holes can be produced across the width of the sheet by repeating the arrangements described above one or more times across the width of the caster.

As with the consideration of change in the cross sectional form of the cast strip described above with respect to control of the position of the edge of the cast strip, control and adjustment of the pressure of the molten metal is advantageous when forming holes in the cast strip.

Embodiments are contemplated in which the position of one or more of the edges of the cast strip is controlled by an EM edge dam and EM diverters are also provided in order to form holes at desired positions in the cast strip during casting.

Figure 32:
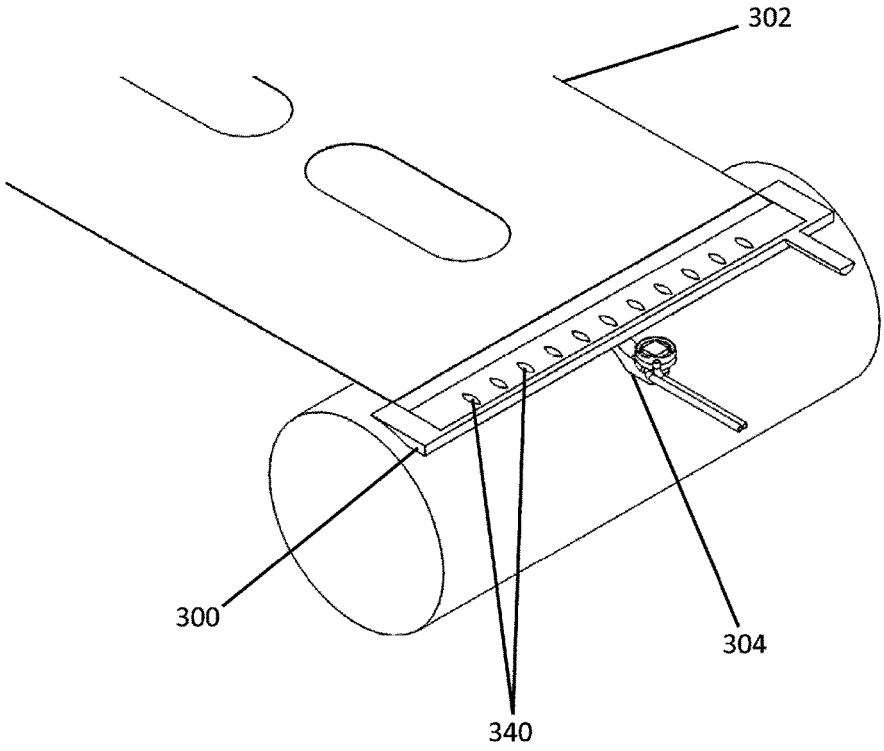
FIG. 32 shows a schematic cross sectional perspective view through the feed tip of a modified embodiment for forming holes in the cast strip.

It is possible facilitate the formation of a hole in the molten metal using a diverter during casting. FIG. 32 shows a schematic cross sectional perspective view through the feed tip 300. An array of baffles 340 is provided. These baffles are formed of non-ferromagnetic and preferably non-conductive material. For example, they can be formed of ceramic, such as the same material from which the remainder of the feed tip is formed. Their effect is to force the molten metal to flow around them in order to reach the bite of the rolls. The magnetic field from the EM diverter 304 can pass more easily through the baffles than through the (conductive) molten metal. Therefore the magnetic field tends to be concentrated at the baffles or baffle closest to the position of the EM diverter. Once a suitably high EM field is generated, a hole is initiated close to the baffle where the EM field is highest. This initiated hole can then be expanded or moved for subsequently-arriving molten metal by suitable control of the EM diverter. It is considered that the effect of such a baffle is to allow the EM field to push the molten metal sideways, rather than sideways and forwards.

Figure 33:
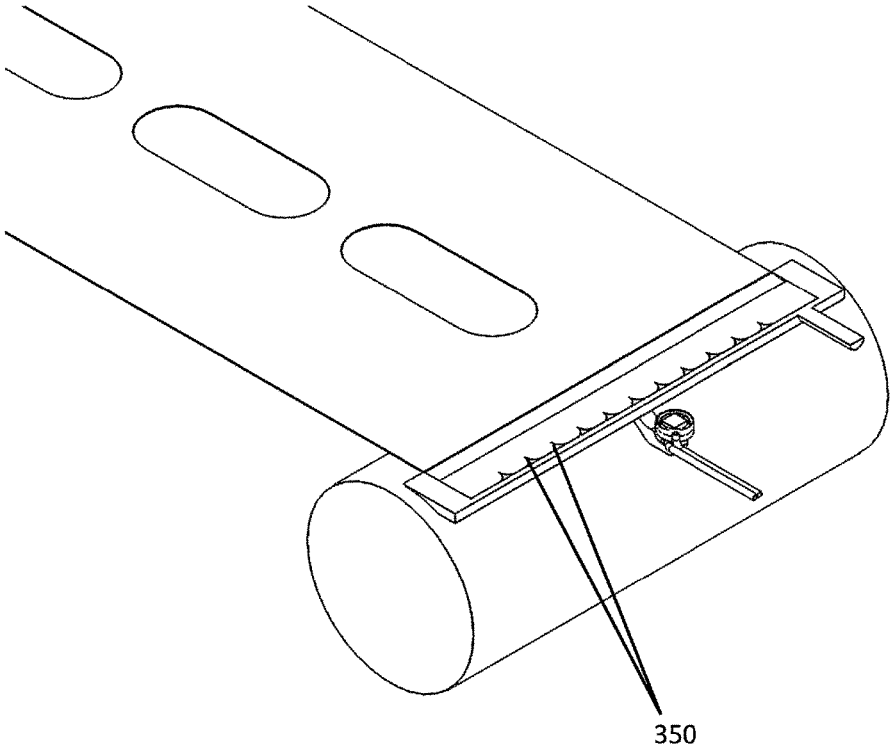
FIG. 33 shows an alternative embodiment to that of FIG. 32.

FIG. 33 shows an alternative embodiment to that of FIG. 32 in which the rear internal face of the feed tip has an array of ridges 350. These are formed of the same material as the remainder of the feed tip (i.e. ceramic). Their effect is similar to the effect of the baffles of FIG. 32, allowing the initiation of a hole by suitable control of the EM diverter.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

All references referred to above and/or listed below are hereby incorporated by reference.

LIST OF REFERENCES

Cullen, J. M. & Allwood, J. M., 2013. Mapping the global flow of aluminum: from liquid aluminum to end-use goods. Environmental science & technology, 47(7), pp. 3057-64.

Davidson, P., 2001. An introduction to magnetohydrodynamics First., Cambridge, United Kingdom: Cambridge University Press, Chapter 12, pp 387-404.

Ferry, M., 2006. Direct strip casting of metals and alloys, Cambridge: Woodhead Publishing Limited, Chapter 3, pp 63-98 and Chapter 4, pp 101-151.

Gale, W. F., Smithells, C. J. & Totemeier, T. C., 2004. Smithells metals reference book, Butterworth-Heinemann, Chapter 20.

Gerber, H. & Blazek, K., 2000. Twin-roll casting with an electromagnetic edge dam. Conference Record of the 2000 IEEE Industry Applications Conference. Thirty-Fifth IAS Annual Meeting and World Conference on Industrial Applications of Electrical Energy (Cat. No. 00CH37129), pp. 2572-2577.

Li, B., 1998. Solidification processing of materials in magnetic fields. JOM, 50(2), pp. 1-13.

Mao, D., 2003. The principle and technology of electromagnetic roll casting. Journal of Materials Processing Technology, 138(1-3), pp. 605-609.

McBrien, M. & Allwood, J., 2013. Preliminary Design and Assessment of a Novel Electromagnetic Edge Dam for Aluminium Twin Roll Casting. Materials Science Forum, 765, pp. 87-91.

Milford, R. L., Allwood, J. M. & Cullen, J. M., 2011. Assessing the potential of yield improvements, through process scrap reduction, for energy and CO2 abatement in the steel and aluminium sectors. Resources, Conservation and Recycling, 55(12), pp. 1185-1195.

Monaghan, D. et al., 1993. Microstructural defects in high productivity twin-roll casting of aluminium. Materials Science and Engineering: A, 173(1-2), pp. 251-254.

Romano, E. & Romanowski, C., 2009. Reinventing twin roll casting for the 21st century. In TMS Light metals 2009.

Smith, D., Keles, O. & Dogan, N., 2004. Fata Hunter Optiflow® variable tip width adjustment system for aluminium sheet casting. In LIGHT METALS-WARRENDALE-PROCEEDINGS—. TMS, pp. 719-722.

Vives, C., 1989. Electromagnetic refining of aluminum alloys by the CREM process: Part I. Working principle and metallurgical results. Metallurgical and Materials Transactions B, 2013(October 1989), pp. 623-629.

Whittington, K. et al., 1998. Strip edge containment and position control in twin roll aluminium casting by an electromagnetic method. In TMS Light Metals 1998.

The invention claimed is:

1. A continuous casting apparatus for casting a metal strip with a cross sectional form which varies along the length of the strip, the continuous casting apparatus comprising:

opposing cooling means;

a molten metal feed system positionable to provide a molten metal feed for solidification between the opposing cooling means to form a solidified metal strip along a length direction;

a form adjustment system comprising at least one dam to determine, at least in part, the cross sectional form of the molten metal feed to the opposing cooling means, and thereby to determine the cross sectional form of the solidified metal strip, wherein the at least one dam is moveable during operation of the apparatus to vary the cross sectional form of the molten metal feed to the opposing cooling means; and the continuous casting apparatus further comprising a molten metal pressure control system, operable to control the pressure of the molten metal in the molten metal feed during operation of the apparatus in coordination with movement of the at least one dam.

2. The continuous casting apparatus according to claim 1, wherein the continuous casting apparatus is a twin roll casting apparatus.

3. The continuous casting apparatus according to claim 1, wherein the at least one dam is an AC electromagnetic field dam provided by at least one electromagnet.

4. The continuous casting apparatus according to claim 1, wherein the molten metal feed system includes a feed tip in fluid communication with a molten metal reservoir via a conduit, the pressure of molten metal at the feed tip being controlled by controlling the pressure of molten metal in the reservoir.

5. The continuous casting apparatus according to claim 1, wherein there is provided at least two dams at different positions, the at least two dams being capable of being selectively switched into operation.

6. The continuous casting apparatus according to claim 1, wherein the at least one dam is selected from:

an edge dam, operable to control the position of the edge of the cast strip; and a diverter, operable to divert the flow of molten metal to form an opening in the cast strip.

7. A continuous casting method for casting a metal strip with a cross sectional form which varies along the length of the strip, the method comprising:

providing a molten metal feed for solidification between two opposing cooling means to form a solidified metal strip along a length direction;

operating a form adjustment system comprising at least one dam to determine, at least in part, the cross sectional form of the molten metal feed to the opposing cooling means, and thereby to affect the cross sectional form of the solidified metal strip, wherein the at least one dam is moved during operation of the device to vary the cross sectional form of the molten metal feed to the opposing cooling means; and operating a molten metal pressure control system to control the pressure of the molten metal in the molten metal feed during casting in coordination with movement of the at least one dam.

8. The continuous casting method according to claim 7, including the step of moving the at least one dam transversely to the length direction of the strip.

9. The continuous casting method according to claim 7, wherein the molten metal feed system includes a feed tip in fluid communication with a molten metal reservoir via a conduit, the method further comprising controlling the pressure of molten metal at the feed tip by controlling the pressure of molten metal in the reservoir by at least one of:

controlling the level of molten metal in the reservoir; and control of displacement of molten metal in the reservoir.

10. The continuous casting method according to claim 7, wherein, when the at least one dam is moved so as to increase the width of the strip, the molten metal pressure is increased.

11. The continuous casting method according to claim 10, wherein, once the at least one dam has been moved to increase the width of the strip and the width has increased to the desired amount, the molten metal pressure is reduced.

12. The continuous casting method according to claim 7, wherein, when the at least one dam is moved so as to decrease the width of the strip, the molten metal pressure is decreased.

13. The continuous casting method according to claim 12, wherein, once the at least one dam has been moved to decrease the width of the strip and the width has decreased to the desired amount, the molten metal pressure is increased.

14. A continuous casting apparatus for casting a metal strip with a cross sectional form which varies along the length of the strip, the continuous casting apparatus comprising:

opposing cooling means;

a molten metal feed system positionable to provide a molten metal feed for solidification between the opposing cooling means to form a solidified metal strip along a length direction; and a form adjustment system comprising at least one diverter, wherein the at least one diverter is operational to part the molten metal feed laterally in order to vary the cross sectional form of the molten metal feed to the rollers and thus the cross sectional form of the solidified metal strip, thereby providing at least one hole in the solidified metal strip.

15. The continuous casting apparatus according to claim 14, wherein the continuous casting apparatus is a twin roll casting apparatus.

16. The continuous casting apparatus according to claim 14, wherein the at least one diverter is an AC electromagnetic field diverter provided by at least one electromagnet.

17. The continuous casting apparatus according to claim 14, wherein there is provided an array of at least two diverters at different positions, the array of at least two diverters being capable of being selectively switched into operation.

18. The continuous casting apparatus according to claim 14, wherein there is provided a molten metal pressure control system, operable to control the pressure of the molten metal in the molten metal feed during operation of the apparatus in coordination with operation of the at least one diverter.

19. The continuous casting apparatus according to claim 14, wherein the molten metal feed system includes a feed tip in fluid communication with a molten metal reservoir via a conduit.

20. The continuous casting apparatus according to claim 19, wherein at least one bypass conduit is provided for molten metal to bypass the at least one diverter to reach a transverse side of the at least one diverter distal from a main feed conduit to the feed tip.

* * * * *